US006182918B1

(12) United States Patent
Shinozuka

(10) Patent No.: US 6,182,918 B1
(45) Date of Patent: Feb. 6, 2001

(54) LOWER THREAD WINDING DEVICE

(75) Inventor: Toshinobu Shinozuka, Tokyo (JP)

(73) Assignee: Juki Corporation, Tokyo (JP)

( * ) Notice: Under 35 U.S.C. 154(b), the term of this patent shall be extended for 0 days.

(21) Appl. No.: 09/239,195

(22) Filed: Jan. 28, 1999

(30) Foreign Application Priority Data

Feb. 2, 1998 (JP) ..... 10-021081

(51) Int. Cl.[7] ..... D05B 59/04

(52) U.S. Cl. ..... 242/475.7; 242/474.2; 112/180; 112/279

(58) Field of Search ..... 112/180, 279, 112/186; 242/473.8, 474.2, 474, 475.7

(56) References Cited

U.S. PATENT DOCUMENTS 5,603,273 * 2/1997 Nakamura et al. ..... 112/180 X
5,606,927 * 3/1997 Nakamura et al. ..... 112/180 X
5,694,874 * 12/1997 Nakamura et al. ..... 112/180 X
5,769,016 * 6/1998 Shinozuka ..... 112/180 X
5,769,343 * 6/1998 Tomioka et al. ..... 112/279 X
5,839,679 * 11/1998 Katayama et al. ..... 112/279 X

FOREIGN PATENT DOCUMENTS 7-68071 * 3/1995 (JP) .
8-229262 * 9/1996 (JP) .
8-318075 * 12/1996 (JP) .
9-75570 3/1997 (JP) .

* cited by examiner

*Primary Examiner*—Donald P. Walsh
*Assistant Examiner*—Collin A. Webb
(74) *Attorney, Agent, or Firm*—Morgan & Finnegan L.L.P.

(57) ABSTRACT

A lower thread winding device is structured such that it comprises: lower thread supply means for guiding a lower thread out from a lower thread supply source and also for supplying the lower thread to a bobbin through an opening formed in a bobbin case; bobbin rotate means including a rotary body disposed on a bobbin within the bobbin case in such a manner as to be contactable with and separatable from the bobbin, the bobbin rotate means being capable of rotating the bobbin due to mutual contact between the rotary body and bobbin to thereby wind the lower thread around the bobbin; and, a thread handling member, after completion of winding of the lower thread around the bobbin, for handling a lower thread extended from the bobbin case to the lower thread supply source to thereby guide the lower thread from the opening of the bobbin case up to a slit formed in the peripheral side surface of the bobbin case. The lower thread winding device is characterized in that, when the thread handling member guides the lower thread, the pressing forces of the rotary member and bobbin against each other is weakened to thereby set them in a half-clutch state.

8 Claims, 16 Drawing Sheets

LOWER THREAD WINDING DEVICE

BACKGROUND OF THE INVENTION

1. Field of the Invention

The present invention relates to a lower thread winding device which is used to wind a lower thread around a bobbin disposed within a bobbin case and, after then, deal with the lower thread extended from the bobbin case and guide it from an opening formed in the bobbin case to a slit formed in the bobbin case.

2. Description of the Related Art

Recently, for example, in Japanese Patent Publication No. 9-75570 of Heisei, there is proposed a lower thread winding device which is capable of executing an automatic winding operation to wind a lower thread around a bobbin.

The lower thread winding device of this type, for example, as shown in FIG. 2, comprises lower thread supply means 30 which is used to supply a lower thread L to a bobbin 15 disposed within a bobbin case 10, bobbin rotate means 20 which rotates the bobbin 15 in order to wind the lower thread L around the bobbin 15, and a thread handling member 40 which, in order to set one end side of the lower thread L under a lower thread tension adjust spring 11 disposed within the bobbin case 10 after the lower thread L is supplied to the bobbin 15, handles one end side of the lower thread L and guides it from an opening 10*a* to a slit 10*b* respectively formed in the bobbin case 10.

The lower thread supply means 30 comprises a thread supply nozzle 36 for guiding the lower thread from the leading end portion of the lower thread supply means 30, and a motor which is used to rotate the thread supply nozzle 36 in such a manner that the leading end portion of the thread supply nozzle 36 can be moved to an initial operation position N1 facing the opening 10*a* of the bobbin case 10, a lower thread winding position N2 spaced apart from the bobbin case 10, and a thread cutting position N5.

The bobbin rotate means 20 comprises a rotary body 25 disposed in such a manner that the bobbin 15 within the bobbin case 10 can be contacted with and removed from the rotary body 25, and buffer means 24 which is used to energize the rotary body 25 with a buffer force in a direction where the rotary body 25 is pressed against the bobbin 15; and, the bobbin rotate means 20 is structured such that it contacts and presses the bobbin 15 stored in the bobbin case 10 against the rotary body 25 to thereby rotate the bobbin 15.

The thread handling member 40 is formed in a shape which corresponds to the peripheral side surface of the bobbin case 10 and is structured such that it can be rotated around the bobbin case 10 along the bobbin case 10 peripheral side surface through a given course to handle the lower thread L extended to the opening 10*a* of the bobbin case 10, thereby moving the lower thread L from the opening 10*a* of the bobbin case 10 to the slit 10*b* thereof (see FIG. 5).

Referring here to the thread handling operation of related art to be executed by the thread handling member 40, as shown in FIG. 5, because it is necessary to pass the lower thread L between the edge portion 10*g* of the bobbin case 10 on the open surface 10*f* side thereof and the flange 15A of the bobbin 15, the thread handling operation is executed in such a state that the bobbin 15 stored within the bobbin case 10 is separated from the rotary body 25 of the bobbin rotate means 20 and the bobbin 15 is thereby free from the rotary body 25 However, in the above-mentioned conventional lower thread winding device, if the lower thread is wound around the bobbin nearly 100%, then the lower thread does not reach the slit of the bobbin case when carrying out the thread handling operation but stops halfway. As a result, in a thread guiding operation in which the lower thread is guided below the lower thread tension adjust spring of the bobbin case, because the lower thread has not arrived at the slit, the lower thread is guided in a poor manner.

Referring to the reason why the lower thread cannot reach the slit, if the lower thread is wound around the bobbin nearly 100%, then the portion of the lower thread that is extended out from the bobbin case lies down (that is, the guide portion of the lower thread extended externally of the bobbin lies on the bobbin peripheral edge side that is distant from the bobbin center portion, so that the guide angle of the lower thread extended externally of the bobbin becomes small) and, therefore, when the thread handling member moves on the edge portion of the bobbin case on the open surface side thereof to thereby guide the lower thread into between the present edge portion and the flange of the bobbin, the lower thread is unable to get into between them.

Also, in the above-mentioned lower thread winding device, in the thread handling operation, the bobbin is separated from the rotary body of the bobbin rotate means and is thus free. As a result, for example, when a firm thread is wound around the bobbin, there is a possibility that the flange of the bobbin can stick out from the bobbin case to thereby cause the lower thread to fly externally of the bobbin.

In order to prevent such fly-out of the lower thread, when a span thread or a cotton thread is used, the winding amount of the lower thread around the bobbin must be set less than or equal to 70–80% and, when a Tetoron thread is used, the winding amount of the lower thread around the bobbin must be set less than or equal to 50%.

SUMMARY OF THE INVENTION

The present invention aims at eliminating the drawbacks found in the above-mentioned conventional lower thread winding device. Accordingly, it is an object of the invention to provide a lower thread winding device including a thread handling member which, after a lower thread is supplied, is used to handle the lower thread to move it from an opening to a slit respectively formed in a bobbin case, characterized in that, even when the lower thread is wound around a bobbin nearly 100%, the present thread handling member is able to move the lower thread to the slit of the bobbin smoothly in its thread handling operation and, further, in the thread handling operation, the lower thread is prevented from flying externally of the bobbin.

In attaining the above object, this invention provides a lower thread winding device, comprising: lower thread supply means for guiding a lower thread out from a lower thread supply source and also for supplying the lower thread to a bobbin through an opening formed in a bobbin case; bobbin rotate means including a rotary body disposed on a bobbin within the bobbin case in such a manner as to be contactable with and separatable from the bobbin, the bobbin rotate means being capable of rotating the bobbin due to mutual contact between the rotary body and bobbin to thereby wind the lower thread around the bobbin; and, a thread handling member, after completion of winding of the lower thread around the bobbin, for handling a lower thread extended from the bobbin case to the lower thread supply source to thereby guide the lower thread from the opening of the bobbin case up to a slit formed in the peripheral side surface of the bobbin case, wherein, when the thread handling member guides the lower thread, the pressing forces of the rotary member and bobbin against each other is weakened to thereby set them in a half-clutch state.

According to the invention, when the thread handling member guides the lower thread from the opening of the bobbin case to the slit thereof, the mutual contact between the bobbin stored within the bobbin case and the rotary body of the bobbin rotate means is not removed but is maintained, which can solve the conventional problem that the flange of the bobbin can stick out from the bobbin case and thus the lower thread wound around the bobbin can fly out from the bobbin.

Also, during the lower thread guide by the thread handling member, the rotary body is not set in a full pressing state in which it is fully pressed against the bobbin toward the bobbin case, but is set in a half-clutch state; that is, the bobbin is allowed to float up due to the action of a known idling preventive spring (not shown) disposed in the inner bottom portion of the bobbin case. Thanks to this half-clutch state, the lower thread to be handled by the thread handling member is allowed to pass smoothly through between the edge portion of the bobbin case and the flange of the bobbin and thus move positively from the opening of the bobbin case to the slit thereof.

To set the half-clutch state, in particular, in the invention, when the thread handling member guides the lower thread, the pressing forces of the rotary member and bobbin against each other is weakened until the inner surface of the bobbin flange is situated inwardly of and almost flush with the open surface of the bobbin case. Thanks to the thus set half-clutch state, the position relation between the bobbin and bobbin case can be set best for the purpose of not only preventing the lower thread from flying out but also moving the lower thread smoothly in the thread handling processing.

Now, in a lower thread winding device according to the invention, the rotary body includes a projecting portion and is structured such that, with the projecting portion inserted into a hole portion formed in the flange of the bobbin, it rotates to thereby be able to transmit its rotational movement to the bobbin; and, when the thread handling member guides the lower thread, the pressing forces of the rotary member and bobbin against each other is weakened while the projecting portion of the rotary body remains inserted into the hole portion formed in the flange of the bobbin.

Generally, when the thread handling member guides the lower thread from the opening of the bobbin case to the slit thereof, if the bobbin idles, then the lower thread gives in to resistance applied thereto when it is guided and is thereby pulled out from the bobbin side, so that the lower thread is not able to reach the bobbin case slit. However, with use of the invention, when the thread handling member guides the lower thread from the opening of the bobbin case to the slit thereof, the idling of the bobbin can be prevented, so that the lower thread can be guided to the bobbin case slit positively.

In a lower thread winding device according to the invention, the thread handling member guides the lower thread from the bobbin case opening to the bobbin case slit along the edge portion of the open surface side of the bobbin case, the bobbin is rotated in a direction where the lower thread is guided.

That is, with use of the invention, when the thread handling member guides the lower thread from the opening of the bobbin case to the slit thereof, the lower thread by and between the edge portion of the bobbin case and the flange of the bobbin is pushed toward the bobbin case slit due to the rotation of the bobbin, which allows the lower thread to move smoothly.

Now, this invention also provides a lower thread winding device, comprising: lower thread supply means for guiding a lower thread out from a lower thread supply source and also for supplying said lower thread to a bobbin through an opening formed in a bobbin case; bobbin rotate means for rotating a bobbin stored within the bobbin case so that the lower thread guided out from the lower thread supply means can be wound around the bobbin; a lower thread guide capable of touching the lower thread extending from the lower thread supply means to the bobbin and curving the supply passage of the lower thread to thereby adjust the insertion angle of the lower thread in order to prevent the lower thread supplied from touching the end of the opening of the bobbin case; a thread handling member, after the lower thread is supplied to the bobbin, for handling the lower thread extended from the bobbin case to the lower thread supply source to thereby guide the lower thread from the opening of the bobbin case to a slit formed in the peripheral side surface of the bobbin case; and, a cutting member, after the lower thread is supplied to the bobbin, for cutting a given portion of the lower thread extended out from the bobbin case, wherein at least two of the lower thread guide, thread handling member and cutting member are formed as an integrally united body on the same surface extending along the peripheral side surface of the bobbin case.

That is, with use of the invention, at least two of the lower thread guide, thread handling member and cutting member are formed as an integrally united body, namely, as a single part. This not only can reduce the manufacturing cost of the lower thread winding device but also can make the device compact in structure. In more particular, thanks to the compact structure, even in a lower thread winding device structured such that the thread supply means and bobbin rotate means are clustered close together and thus there is left only a limited space in the periphery of the bobbin, the lower thread guide, thread handling member and moving knife can be installed in the periphery of the bobbin case.

Now, this invention also provides a lower thread winding device, comprising: lower thread winding means for supplying a lower thread guided out from a lower thread supply source from an opening formed in a bobbin case to thereby wind the lower thread around a bobbin; and, a thread handling member, after the lower thread is supplied to the bobbin, for handling the lower thread extended out from the bobbin case to the lower thread supply source to thereby guide the lower thread from the opening of the bobbin case to a slit formed in the peripheral side surface of the bobbin case, wherein the thread handling member is disposed almost on the same surface extending along the peripheral side surface of the bobbin case and is able to rotate along the peripheral side surface to thereby handle the lower thread, and also wherein the thread handling member has a given width length in the peripheral direction of the peripheral side surface of the bobbin case, whereby the thread handling member, on one side of the peripheral direction, handles the lower thread and, on the other side of the peripheral direction, holds the lower thread on the lower thread supply side, thereby allowing the lower thread on the lower thread supply side to be kept spaced apart from the peripheral side surface of the bobbin case.

That is, with use of the invention, when the thread handling member handles and guides the lower thread, the lower thread on the lower thread supply source side can be kept spaced apart from the bobbin case. This can surely prevent the possibility that the lower thread on the lower thread supply source side can be entwined in the structure of the lower thread winding means, or can be caught and cut therein.

DESCRIPTION OF THE PREFERRED EMBODIMENTS

Now, description will be given below of a preferred embodiment of a lower thread winding device according to the invention with reference to FIGS. 1 to 16.

Figure 1:
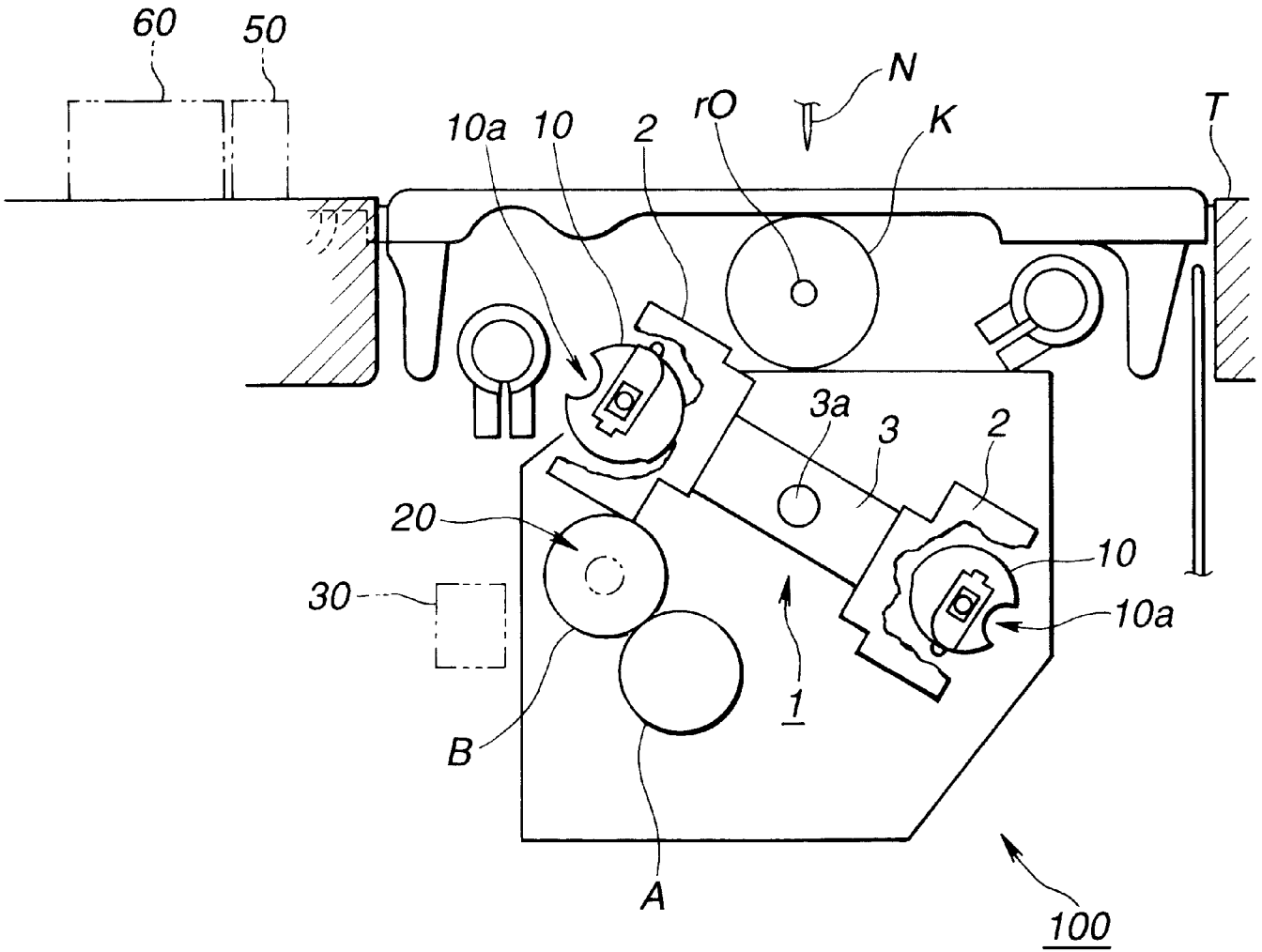
FIG. 1 is a front view of a lower thread automatic supply apparatus incorporating therein a lower thread winding device according to an embodiment of the invention.
Figure 2A:
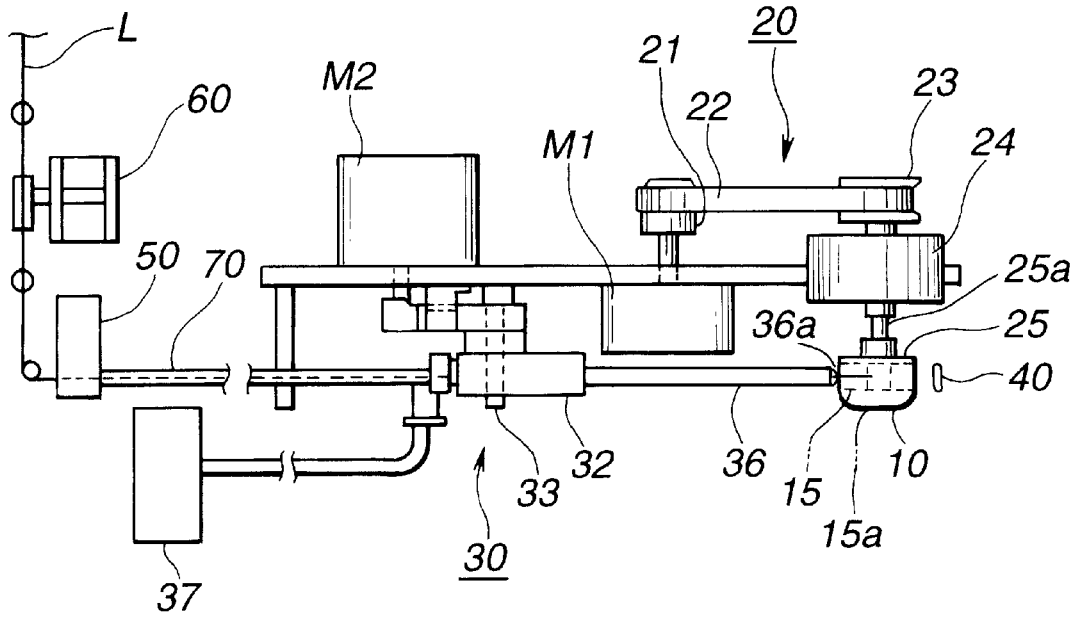
FIG. 2 shows the above lower thread winding device; in particular, FIG. 2(*a*) is a top plan view thereof; and, FIG. 2(*b*) is a front view thereof.
Figure 2B:
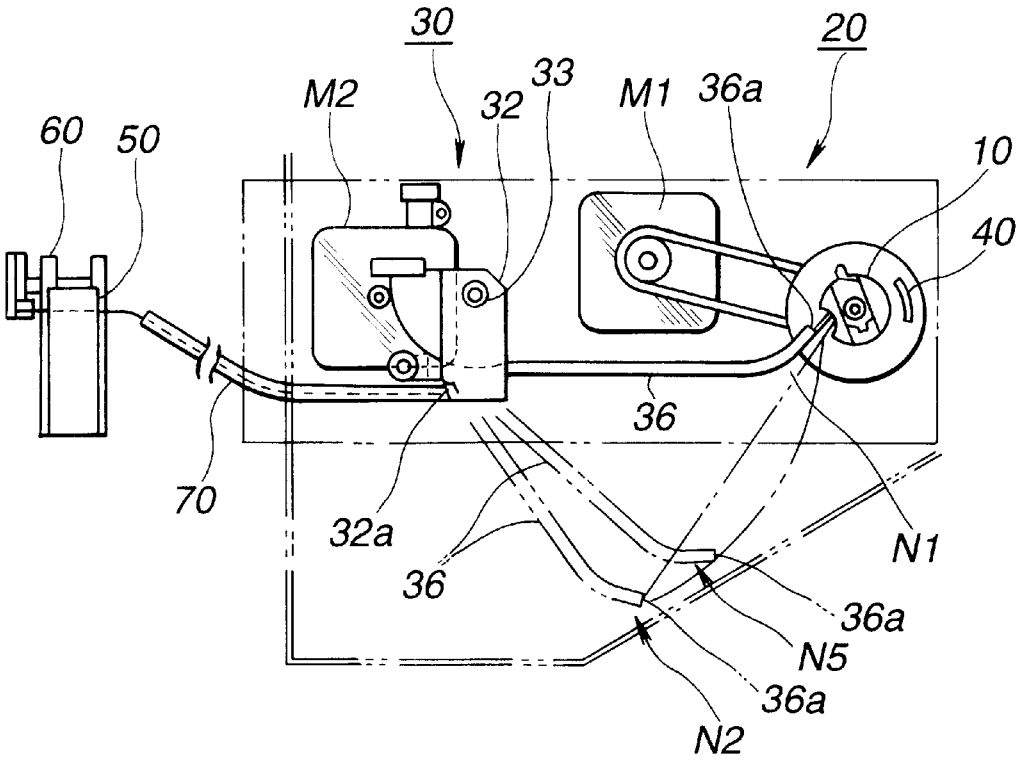
Figure 3A:
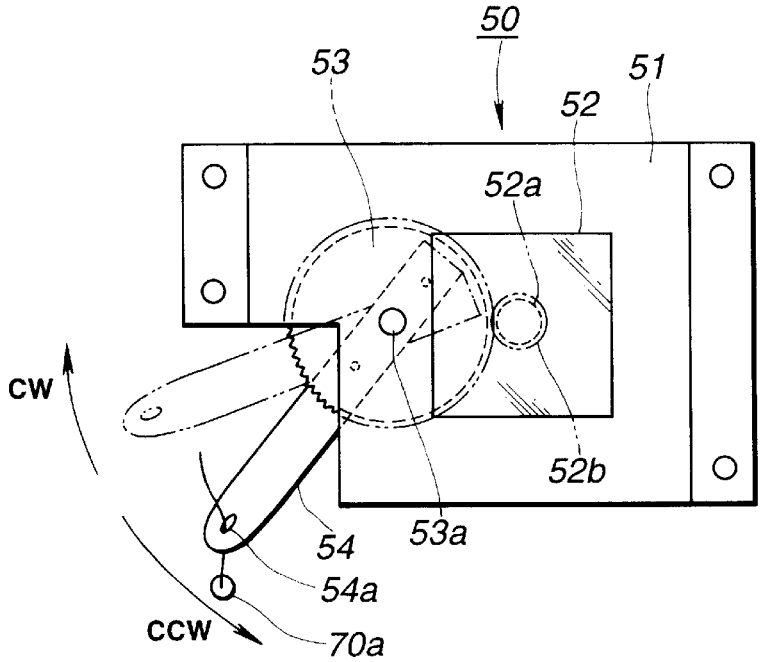
FIG. 3 shows the details of a lower thread storage/guide mechanism 50 employed in the lower thread winding device; in particular, FIG. 3(*a*) is a plan view thereof; and, FIG. 3(*b*) is a front view thereof.
Figure 3B:
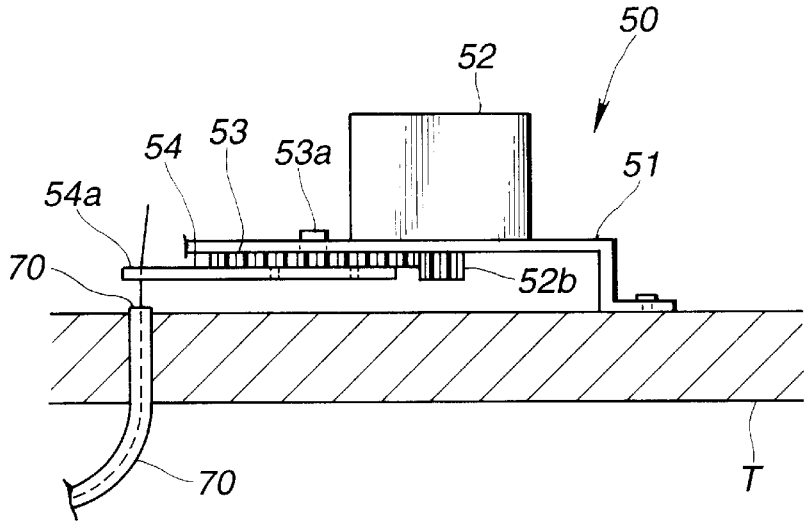
Figure 4A:
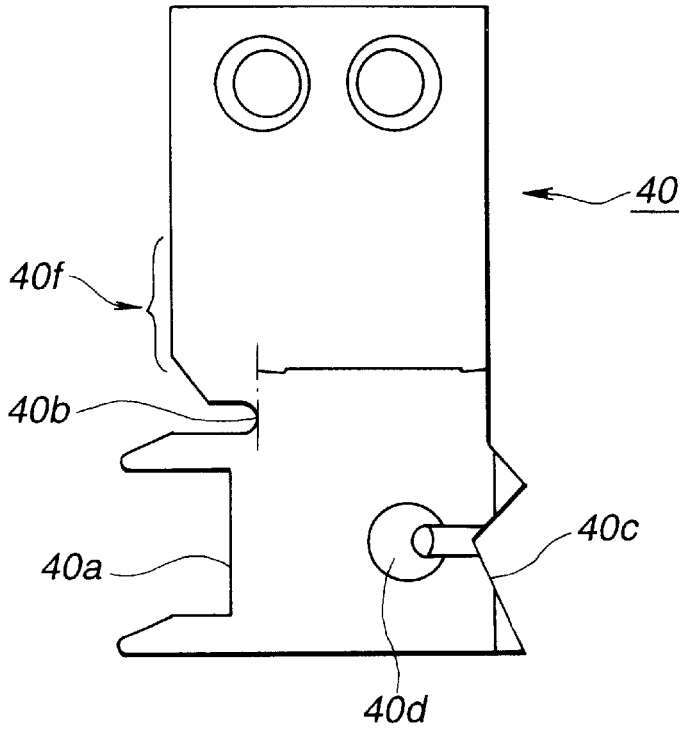
FIG. 4 shows a thread handling member with a moving knife; in particular, FIG. 4(*a*) is a plan view thereof; and, FIG. 4(*b*) is a side view thereof.
Figure 4B:
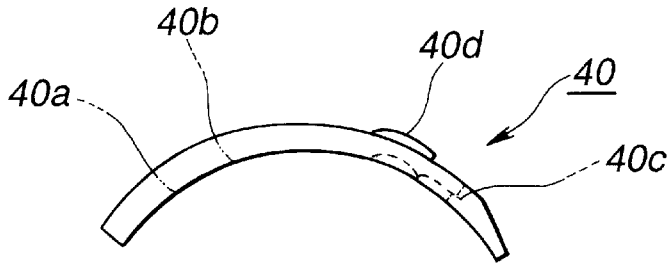
Figure 5A:
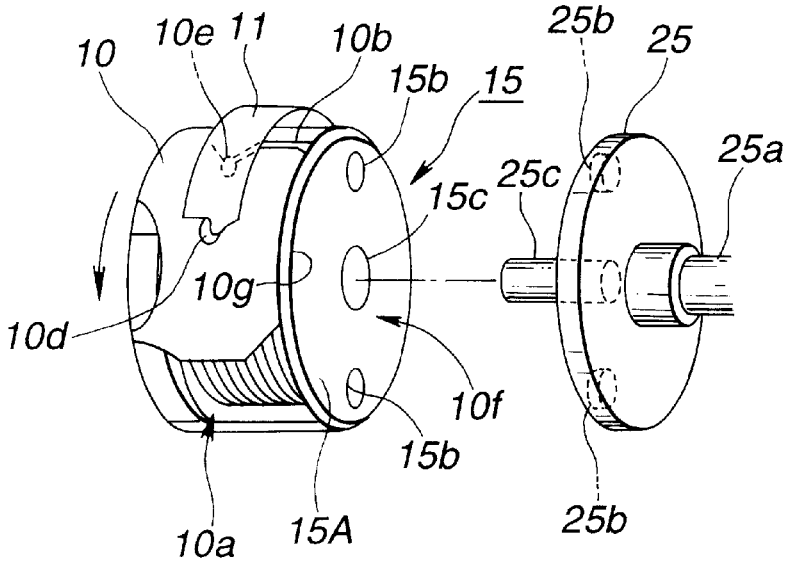
FIG. 5 shows the outlines of a bobbin case and a bobbin both of which are to be handled by the lower thread winding device; in particular, FIG. 5(*a*) is a perspective view thereof; and, FIG. 5(*b*) is a plan view of the main portions thereof on the peripheral side surface of the bobbin case.
Figure 5B:
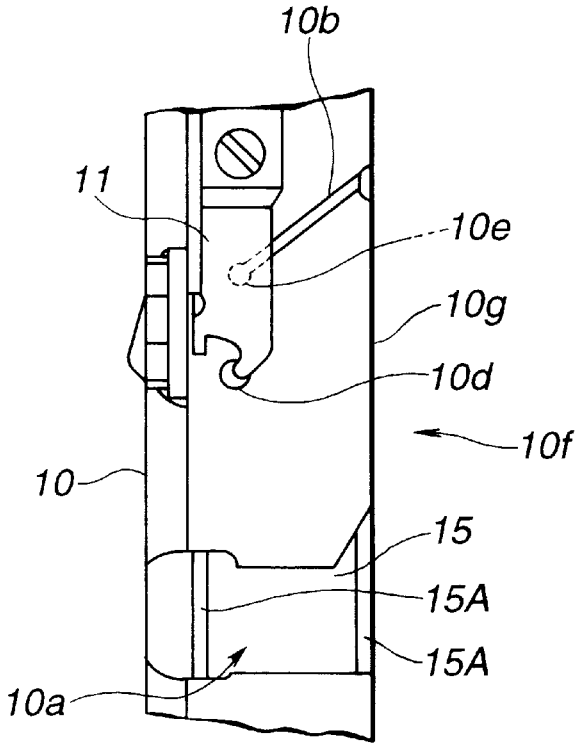

FIG. 1 is a front view of a lower thread automatic supply apparatus 100 incorporating therein a lower thread winding device according to the present embodiment of the invention. In FIG. 1, reference character N designates a sewing-machine needle, K stands for a sewing-machine pot, and T expresses a sewing-machine bed. FIG. 2 shows the present lower thread winding device: in particular, FIG. 2(*a*) is a top plan view thereof, and, FIG. 2(*b*) is a front view thereof. FIG. 3 shows the details of a lower thread storage/guide mechanism 50 employed in the present lower thread winding device: in particular, FIG. 3(*a*) is a plan view thereof; and, FIG. 3(*b*) is a front view thereof. FIG. 4 shows a thread handling member with a moving knife: in particular, FIG. 4(*a*) is a plan view thereof; and, FIG. 4(*b*) is a side view thereof. FIG. 5 shows the outlines of a bobbin case 10 and a bobbin 15 both of which are to be handled by the present lower thread winding device: in particular, FIG. 5(*a*) is a perspective view thereof, and, FIG. 5(*b*) is a plan view of the main portions thereof on the peripheral side surface of the bobbin case.

The present lower thread automatic supply apparatus 100 is an apparatus which, when the lower thread of the bobbin stored within the sewing-machine pot K is consumed and thus the remaining amount thereof becomes less than or equal to a given amount, not only automatically replaces the bobbin and bobbin case 10 within the sewing-machine pot with a new bobbin with a lower thread set therein and a new bobbin case 10 with the new bobbin stored therein but also automatically supplies or replenishes a lower thread to the old bobbin with the lower thread consumed and the old bobbin case 10 with the old bobbin stored therein.

The present lower thread automatic supply apparatus 100 comprises hold means 2, 2 capable of holding or releasing the bobbin case 10, a bobbin replacing device 1 including a rotary arm 3 capable of not only rotating the hold means 2, 2 with a support shaft 3*a* as a fulcrum thereof but also moving the hold means 2, 2 linearly in the axial direction of the support shaft 3*a* and the like, a residual thread removal device (not shown), a lower thread winding device for supplying a lower thread to the bobbin, and the like. In FIG. 1, reference Character A designates a residual thread removing position at which the residual lower thread of the bobbin is removed by the residual thread removal device, while B stands for a lower thread winding position at which the lower thread is wound around the bobbin.

Within the structure of the present lower thread automatic supply apparatus 100, the lower thread winding device, which is an embodiment according to the invention, comprises, as shown in FIGS. 1 and 2, bobbin rotate means 20 serving as lower thread winding means, lower thread supply means 30, lower thread storage/guide means 50, and thread supply and detect means 60, or, as shown in FIG. 2 (not shown in FIG. 1), a thread handling member 40 with a moving knife which, when the lower thread is supplied, guides the lower thread, after the lower thread is supplied, handles the lower thread, and cuts the thread, a thread catch mechanism (not shown) (such as a wiper 47 or the like; see FIG. 16), and the like.

The bobbin rotate means 20 is structured in the following manner: that is, as shown in FIG. 2, it drives or rotates a winding motor M1, transmits the rotational drive force of the winding motor M1 through a motor shaft pulley 21, a timing belt 22 and a winding pulley 23 to the rotary shaft 25*a* of a winding clutch plate 25 which is a rotary body, thereby rotating the winding clutch plate 25; and, by means of the rotation of the winding clutch plate 25, the bobbin rotate means 20 rotates a bobbin 15 which is stored within the bobbin case 10 and is held at the lower thread winding position B. The winding clutch plate 25 is connected to the winding pulley 23 through a clutch mechanism 24; and, the winding clutch plate 25 is structured such that it can be pushed in by a given stroke in the rotation axis direction thereof and also, when the winding clutch plate 25 is pushed in, an energizing force is applied in the opposite direction. Also, as shown in FIG. 5(*a*), the winding clutch plate 25 includes a base shaft 25*c* which can be inserted into a through hole 15*c* formed in the bobbin 15 in order to stabilize the rotation of the bobbin 15, and projecting portions 25*b* and 25*b* which can be respectively inserted into hole portions 15*b* previously formed in a flange A of the bobbin 15 to thereby transmit the rotational movement of the winding clutch plate 25 to the bobbin 15.

According to the present bobbin rotate means 20, if the rotary arm 3 is moved linearly in the direction of the winding clutch plate 25 while the bobbin case 10 is being held at the lower thread winding position B by the hold means 2, then the bobbin 15 can be contacted with and pressed against the winding clutch plate 25 to thereby allow the rotation of the winding clutch plate 25 to be transmitted to the bobbin 15; and, on the other hand, if the rotary arm 3 is moved linearly in a direction where it moves away from the winding clutch plate 25, then the bobbin 15 can be moved apart from the winding clutch plate 25 to thereby prevent the rotation of the winding clutch plate 25 from being transmitted to the bobbin 15. And, they can be set in an intermediate state between the above two states, that is, a state, in which the bobbin 15 and winding clutch plate 25 are in contact with each other and they have no (or, a very weak) pressing force with respect to each other, is a half-clutch state.

In the half-clutch state, due to the action of an idling preventive spring provided in the bottom portion of the bobbin case 10, the bobbin 15 is caused to float up from the bottom of the bobbin case 10, so that one flange 15A of the bobbin 15 is caused to come near the open surface 10*f* (FIG. 5). Also, in the half-clutch state, since the projecting portions 25*b* and 25*b* of the winding clutch plate 25 are respectively inserted into the bobbin hole portions 15*b* and 15*b*, the bobbin 15 does not idle but can be rotated in response to the rotation of the winding clutch plate 25.

Now, the lower thread supply means 30 comprises a thread absorbing member 32 which stores in the interior portion thereof a lower thread L supplied from a lower thread supply source, a thread supply nozzle 36, an air source which, when an electromagnetic valve 37 is opened, can supply the air to the supply passage of the lower thread formed within the thread absorbing member 32, and a lower thread supply and rotate motor M2 which rotates the thread absorbing member 32 with a support shaft 33 as a fulcrum thereof to thereby be able to move the thread supply nozzle 36 to an initial operation position N1, a lower thread winding position N2, and a thread cutting position N5. And, to the lower thread introduction portion 32*a* of the thread absorbing member 32, there is connected a guide pipe 70 which is used to guide the lower thread L from the lower thread storage/guide means 50 side.

According to the present lower thread supply means 30, while a portion of the lower thread L having a length necessary to entwine the lower thread L is previously guided from the leading end of the thread supply nozzle 36, the thread supply nozzle 36 is driven by the lower thread supply rotary motor M2 to thereby set the leading end of the thread supply nozzle 36 at the initial operation position N1 near an opening 10*a* formed in the bobbin case 10: at the then time, the air is supplied from the air source and the present air is thus blown out from the leading end of the thread supply nozzle 36, thereby guiding the above guided-out portion of the lower thread into the interior portion of the bobbin case 10 from the bobbin case opening 10*a*; further, at the then time, the present air is blown into the bobbin 15, which is then rotating as it is driven by the above-mentioned winding motor M1, to form an eddy around a bobbin shaft 15*a*, thereby allowing the lower thread L guided into the bobbin case interior portion to be entwined around the bobbin shaft 15*a*; and, after then, the lower thread supply rotary motor M2 is driven in such a manner as to be able to achieve so called even winding, thereby moving the leading end of the thread supply nozzle 36 to the lower thread winding position N2 spaced apart from the above-mentioned initial operation position N1, so that the lower thread can be wound around the bobbin 15.

The thread supply detect mechanism 60 is used to detect the supply of the lower thread L between the lower thread supply source and thread absorbing member 32; for example, the thread supply detect mechanism 60 is structured such that it winds the lower thread around a roller once and also detects the rotation of the roller to thereby detect the supply of the lower thread L. By means of such detection of the lower thread supply, in a CPU 82 which will be discussed later, not only the entwinement of the lower thread L around the bobbin shaft 15*a* but also the amount of the lower thread L to be wound around the bobbin 15 can be detected.

The lower thread storage/guide mechanism 50 is a mechanism which temporarily pulls thereinto and stores therein the lower thread L which exists between the thread supply detect means 60 and thread absorbing member 32, or releases and guides the thus stored lower thread L therefrom. Due to such storage and guide of the lower thread L, not only the lower thread L guided from the nozzle leading end 36*a* of the thread absorbing member 32 can be pulled into and stored in the nozzle 36 but also the thus stored lower thread L can be guided out from the nozzle leading end 36*a*.

The lower thread storage/guide mechanism 50, as shown in FIG. 3, comprises a frame 51, a thread pull-in motor 52, a motor gear 52*b* fixed to the motor shaft 52*a* of the motor 52, a gear 53 fixed to the frame 51 in such a manner that it can be rotated through a rotary shaft 53*a*, a wiper 54 fixed to the gear 53, and the like. In the leading end portion of the wiper 54, there is formed a through hole 54*a* through which the lower thread L can be inserted. If the wiper 54 is rotated clockwise (in FIG. 3(*a*), in a direction of an arrow CW), then the lower thread L inserted through the through hole 54*a* can be pulled out from the absorbing port 70*a* of the guide pipe 70 and stored temporarily within the nozzle 36; and, on the other hand, if the wiper 54 is rotated counterclockwise (in FIG. 3(*a*), in a direction of an arrow CCW), then the thus temporarily stored lower thread L is released and, at the same time, the air is supplied from the air source, so that the lower thread L can be guided out from the nozzle leading end 36a through the absorbing port 70*a* of the guide pipe 70.

The thread handling member 40 with a moving knife is formed in a curved shape like an arc with the bobbin shaft 15*a* as a center thereof and also it has a structure in which a thread catching mechanism, a thread cutting mechanism and a thread guiding mechanism are formed in an integral manner. Also, the thread handling member 40 with a moving knife is supported on a sewing-machine frame in such a manner that it can be rotated on the same axis as the rotary shaft 25*a* of the winding clutch plate 25; and, in particular, if it is driven by a thread-handling-member-with-a moving-knife rotating motor 41 (FIG. 6), then it can be rotated along the peripheral side surface of the bobbin case 10 held at the lower thread winding position B.

The thread handling member 40 with a moving knife includes: a lower thread guiding notch 40*a* which is formed on the leading end side thereof (in FIG. 4(*a*), on the left side thereof) and is used to guide the lower thread when the lower thread is supplied; a thread handling notch 40*b* which is formed in the middle portion of the handling member 40 in such a manner as to adjoin the lower thread guiding notch 40*a* and also which, after the lower thread is supplied, handles the lower thread L extending from the thread supply nozzle 36 to the bobbin 15 to thereby guide the lower thread L from the opening 10*a* of the bobbin case 10 to the slit 10*b* thereof; a thread cutting notch 40*c* which is formed on the rear end side of the handling member 40 (in FIG. 4(*a*), on the right side thereof) and is formed in a V shape; and, a cutting eyeball (moving knife) portion 40*d* which is formed on an extension line starting at the top of the notch 40*c* and extending along the peripheral surface of the handling member 40. The thread cutting notch 40*c* is shifted in position from the thread handling notch 40*b* in the right and left direction (in FIG. 4(*a*), in the vertical direction) of the thread handling member 40 with a moving knife (that is, the thread cutting notch 40*c* is shifted in position from the thread handling notch 40*b* toward the opposite side of the open end edge side of the bobbin case 10). Thanks to this, when the lower thread L is caught on the thread handling notch 40*b* and the present lower thread L extends from the leading end of the thread handling member 40 with a moving knife to the trailing end thereof, the present lower thread L is prevented from touching the cutting knife portion 40*d* on the trailing end side of the thread handling member 40.

The thread handling member 40 with a moving knife has a given width H extending from the thread handling notch 40*b* to the rear end (in FIG. 4(*a*), the right end) of the thread handling member 40; that is, in the thread handling operation, the lower thread L caught on the thread handling notch 40*b* can be moved from the leading end side of the thread handling member 40 to the rear end side thereof, and the lower thread L can be held in the rear end portion. Such holding of the lower thread L causes the passage of the lower thread L on the thread supply nozzle 36 side to be spaced from the bobbin case 10 (see FIG. 7(*f*)).

Now, referring to the operation of the thread catch mechanism (see FIG. 16), after the lower thread L is guided by the thread handling member 40 with a moving knife up to the slit 10*b* previously formed in the peripheral side surface of the bobbin case 10, the thread catch mechanism hitches or catches and guides the lower thread L through between a lower thread tension adjust spring 11 and the peripheral side surface of the bobbin case 10 up to a thread guide portion 10*d* formed in the bobbin case 10. For example, the thread catch mechanism is composed of a base 48 fixed to the base frame of the lower thread automatic supply apparatus 100, a wiper 47 mounted on the base 48 in such a manner that it can be rotated about a fulcrum 48*a* formed in the base 48, drive means for driving the wiper 47 rotationally, and the like. The wiper 47 is a member in which a thread guide member 47*b* extended in the rotation axis direction of the bobbin 15 is formed integrally with a thread catch member 47*a* disposed at right angles to the thread guide member 47*b*; and, in operation, the wiper 47 not only holds the lower thread L, which is guided from the leading end of the thread supply nozzle 36 to the bobbin case 10, by means of the thread guide member 47*b* in a thread handling processing to be discussed later, but also, after the thread handling processing is executed, allows the thread catch member 47*a* to catch or hitch the thread to thereby set the thread in its proper position.

Figure 6:
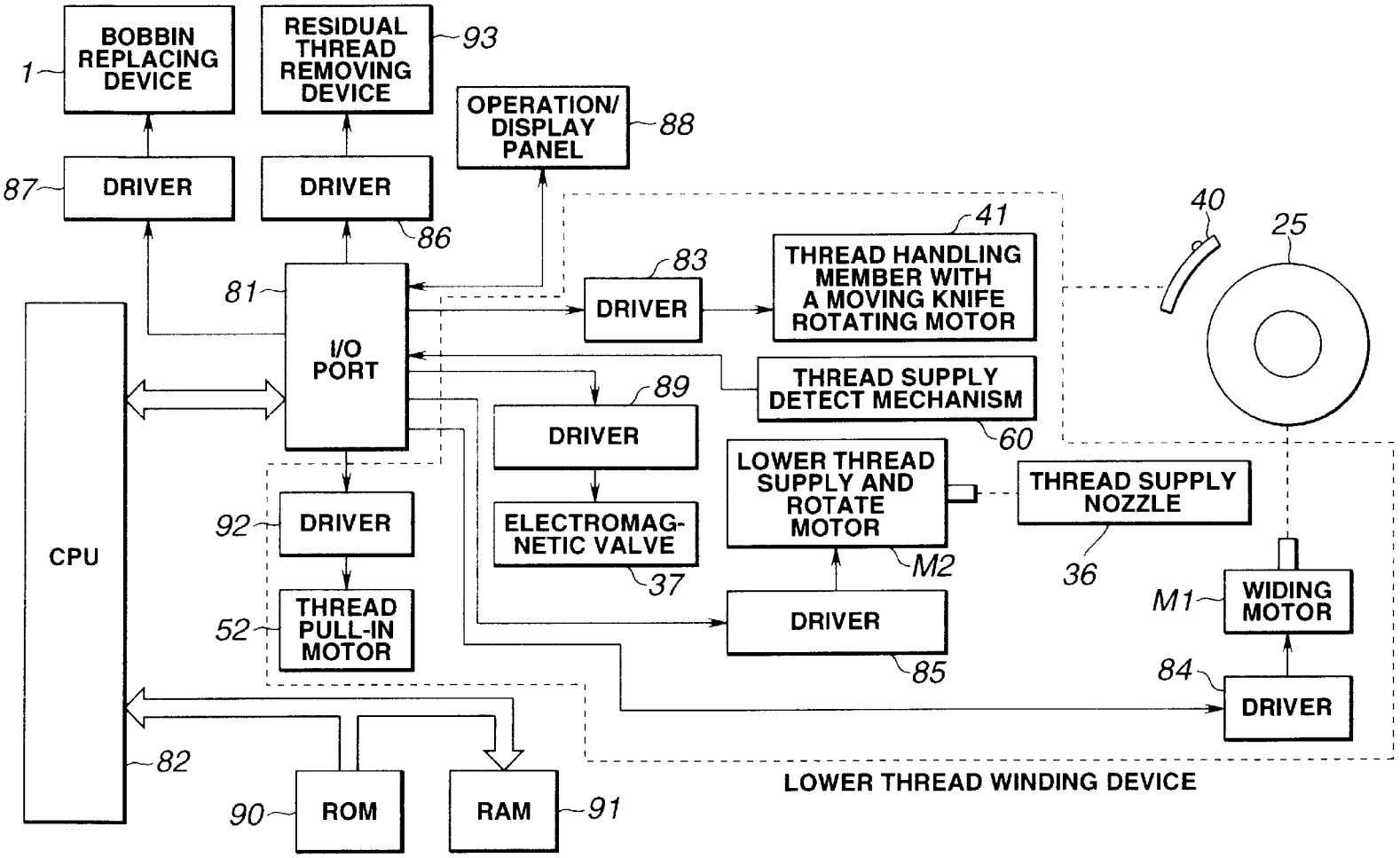
FIG. 6 is a block diagram of the structure of a control part of the lower thread automatic supply apparatus shown in FIG. 1.
Figure 7A:
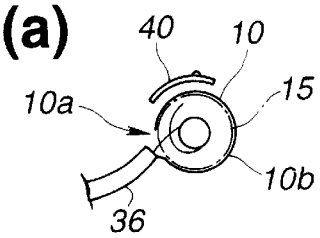
FIG. 7 is a side view of the lower thread winding device shown in FIG. 2, showing the flow of a series of lower thread winding, handling and cutting processings (*a*)–(*h*) to be executed by the present lower thread winding device.
Figure 7B:
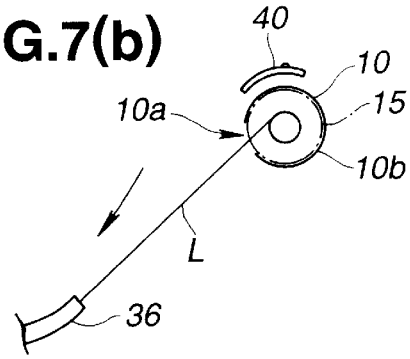
Figure 7C:
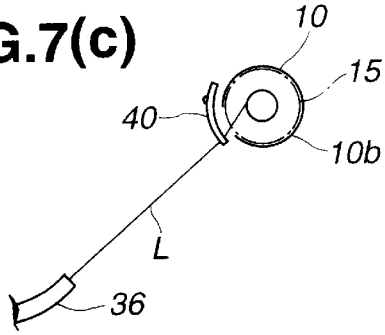
Figure 7D:
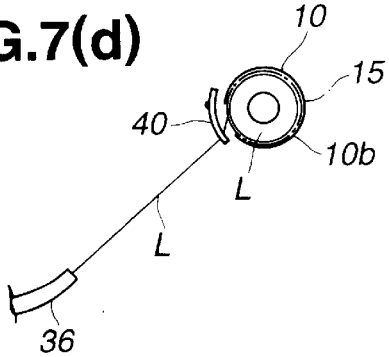
Figure 7E:
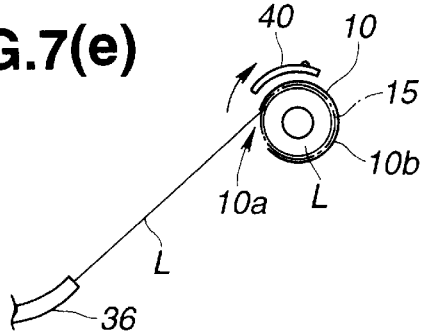
Figure 7F:
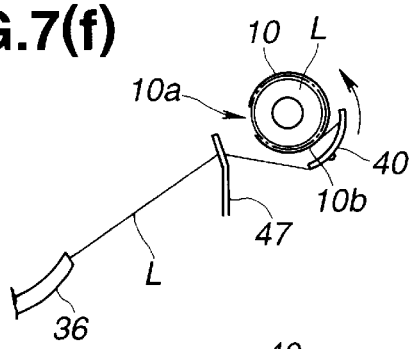
Figure 7G:
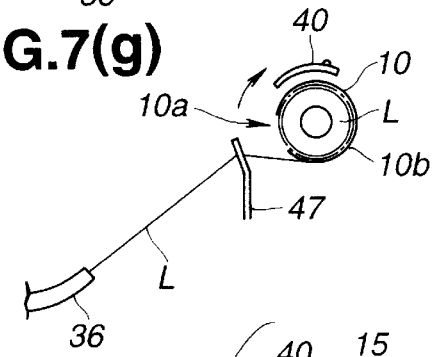
Figure 7H:
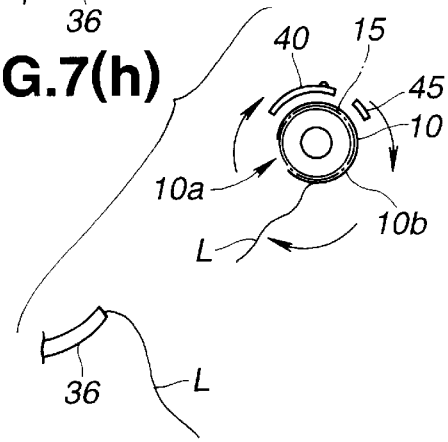
Figure 8:
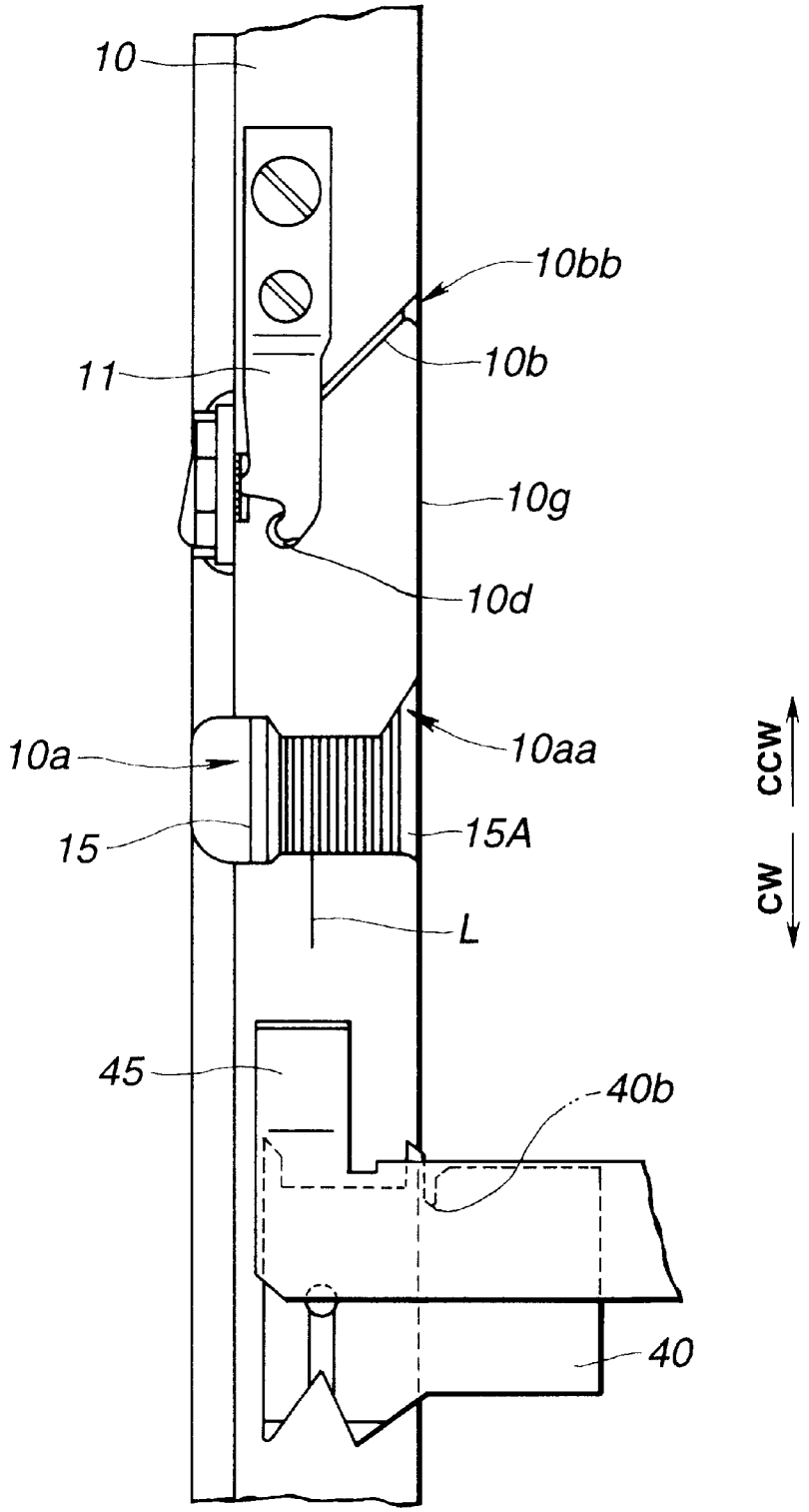
FIG. 8 is a plan view to show the position relation between the bobbin case and the thread handling member with a moving knife in an operation ranging from the thread handling processing to the thread cutting processing, in particular, a first step in the present thread-handling to thread-cutting operation.
Figure 9:
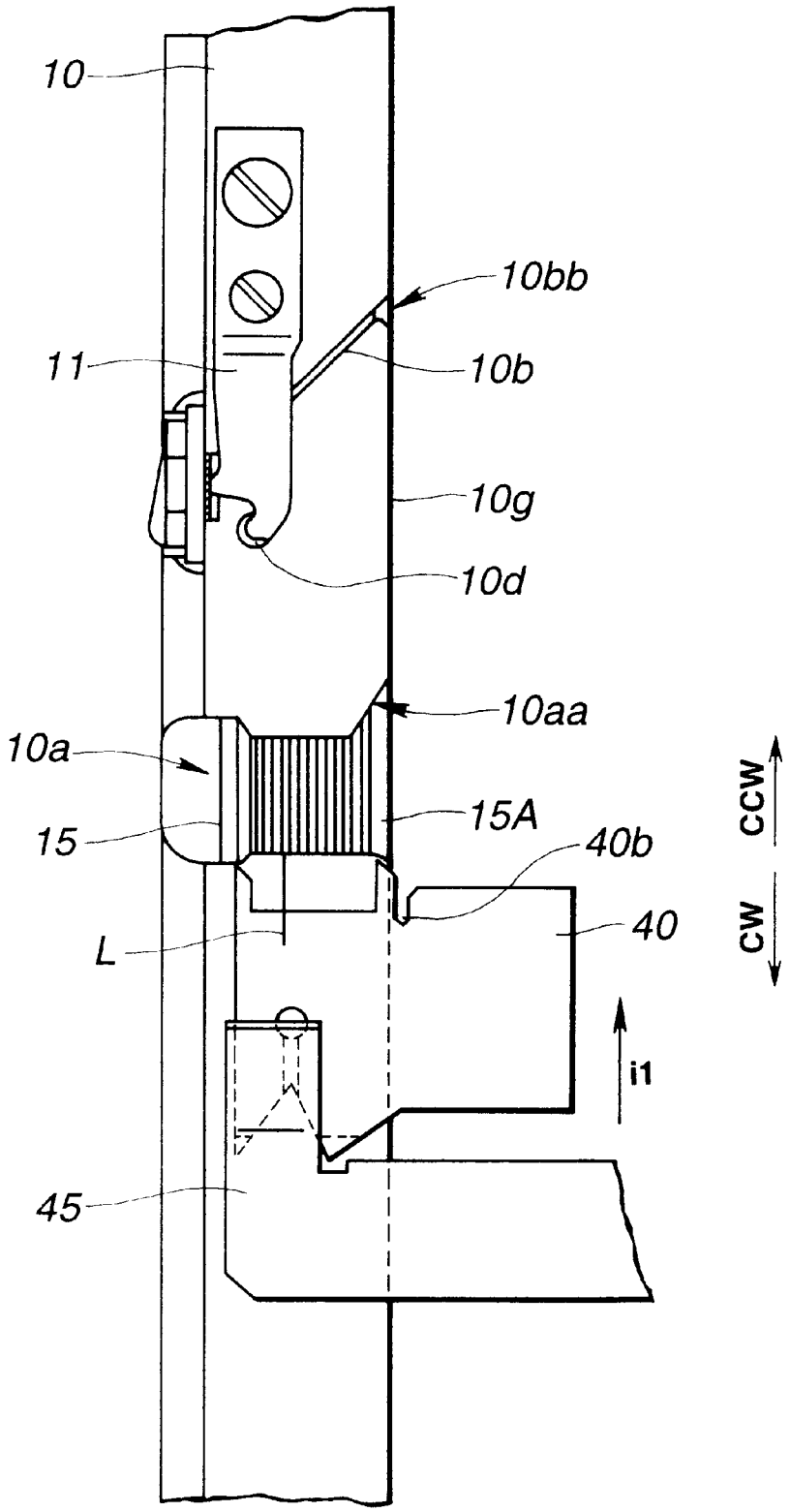
FIG. 9 is a plan view to show a second step in the above thread-handling to thread-cutting operation.
Figure 10:
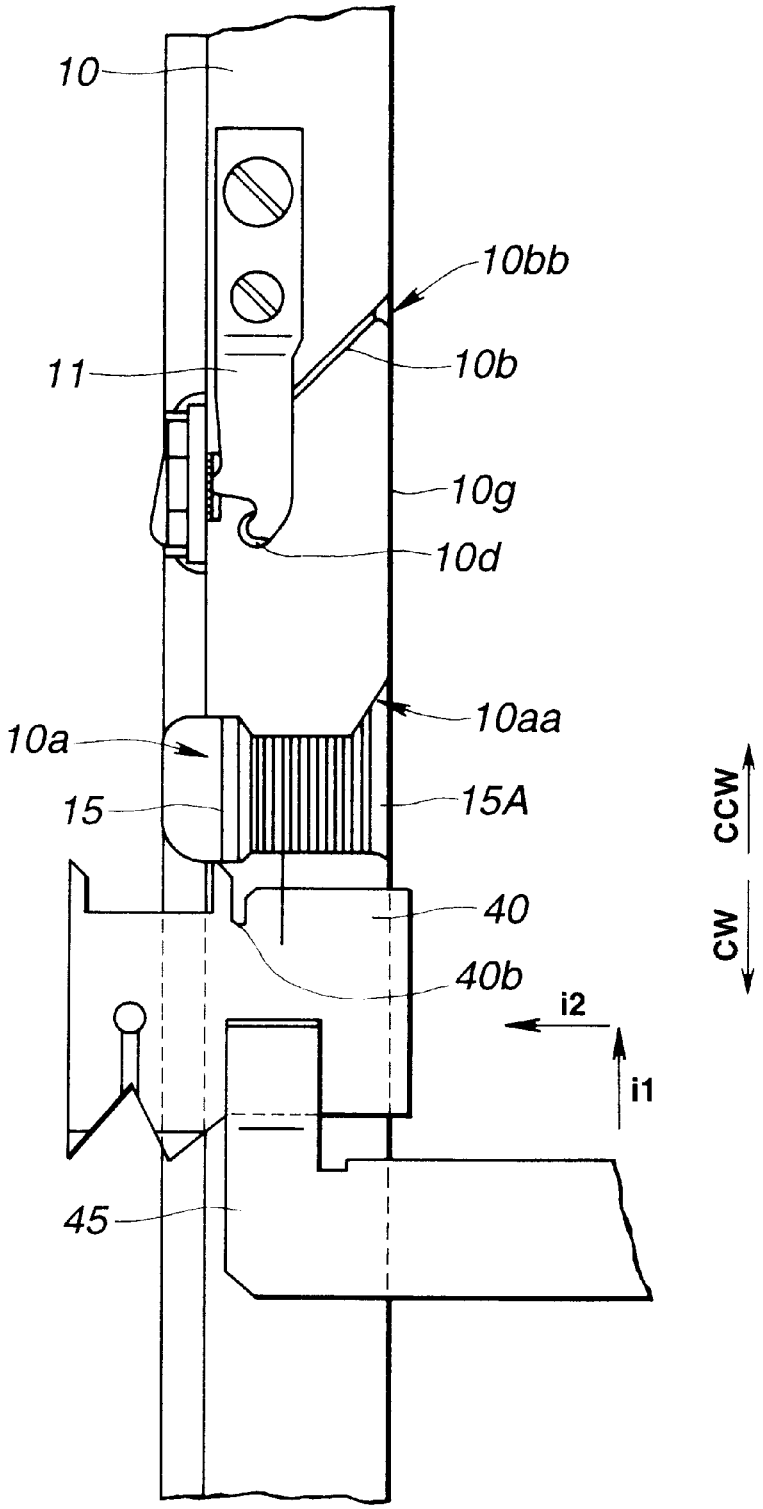
FIG. 10 is a plan view to show a third step in the above thread-handling to thread-cutting operation.
Figure 11:
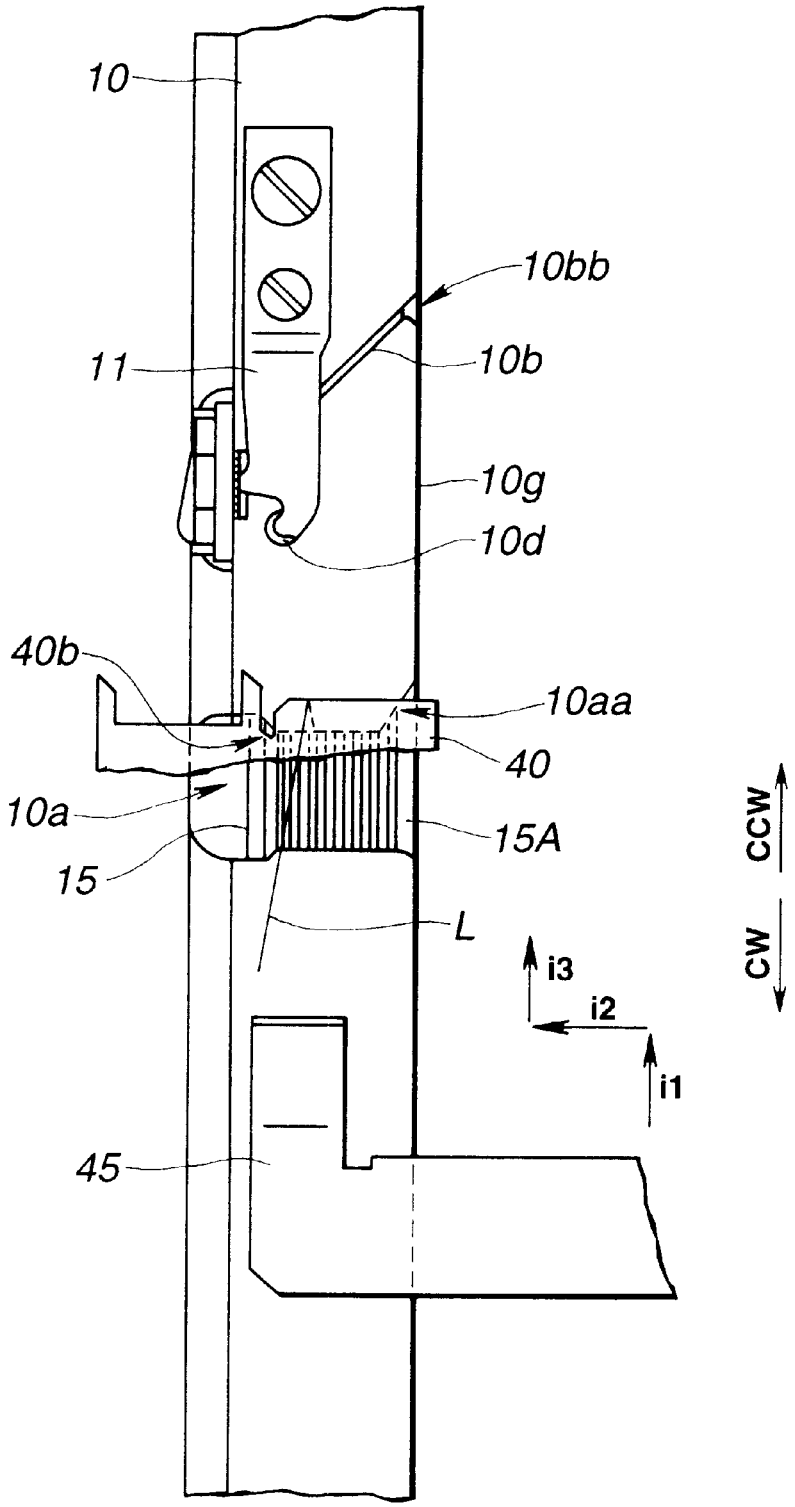
FIG. 11 is a plan view to show a fourth step in the above thread-handling to thread-cutting operation.
Figure 12:
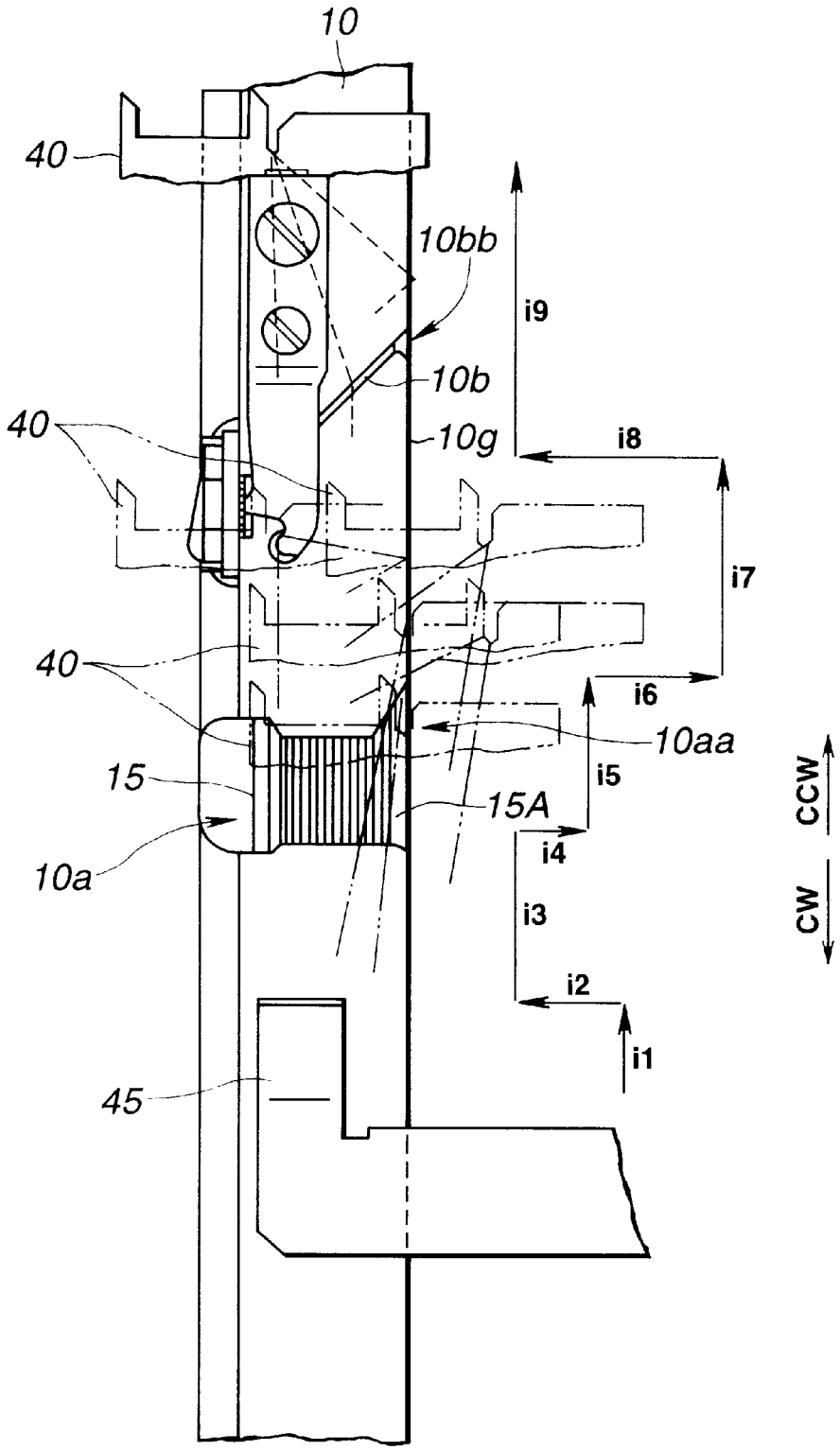
FIG. 12 is a plan view to show a fifth step in the above thread-handling to thread-cutting operation.
Figure 13:
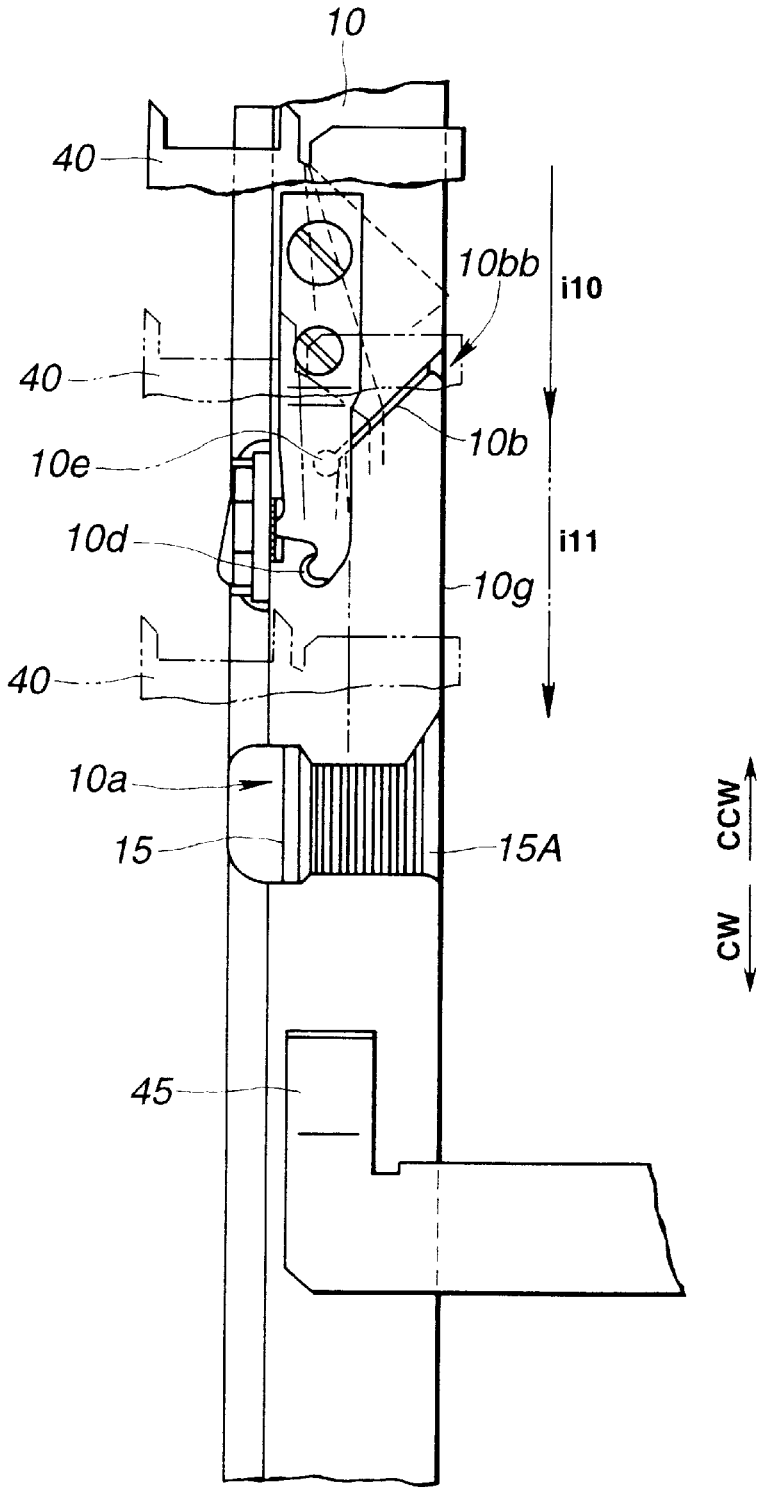
FIG. 13 is a plan view to show a sixth step in the above thread-handling to thread-cutting operation.

Now, FIG. 6 is a block diagram of the structure of a control part of the above-structured lower thread automatic supply apparatus 100.

In particular, the control part of the above-structured lower thread automatic supply apparatus 100 comprises a CPU (Central Processing Unit) 82, a RAM (Random Access Memory) 91, a ROM (Read Only Memory) 90, an I/O port 81, drivers 83–89 belonging to the respective drive parts of the lower thread automatic supply apparatus 100, and the like. To the I/O port 81, through an operation display panel 88, thread supply detect means (mechanism) 60, and the respective drivers 83–89, 92, there are connected various drive equipment such as the bobbin replacing device 1, residual thread removing device 93, thread-handling-member-with-a-moving-knife rotating motor 41, the winding motor M1 of the bobbin rotate means 20, the lower thread supply and rotate motor M2 of the lower thread supply means 30, electromagnetic valve 37, thread pull-in motor 52, and the like. That is, according to sequence processings to be executed by the CPU 82, RAM 91 and ROM 92, the respective drive parts of the lower thread supply apparatus 100 can be controlled in such a manner as to comply with the given control contents of the CPU 82, RAM 91 and ROM 92.

Next, description will be given below of a lower thread automatic supply processing which is executed by the above-structured lower thread automatic supply apparatus 100; and, especially, description will be given in detail of a thread handling processing which is carried out by the lower thread winding device after the lower thread is supplied, with reference to FIGS. 7 to 15.

At first, if the lower thread is consumed during a sewing operation and the amount of the lower thread of the bobbin 15 within the sewing-machine pot K is thereby reduced down below a given amount, then a lower thread automatic supply processing is started and thus the driving of the sewing machine is stopped temporarily. If the lower thread automatic supply processing is started, then, not only due to the rotation of the rotary arm 3 and the linear movement thereof along the support shaft 3*a* but also due to the holding operation of one bobbin hold means 2, the bobbin case 10 within the sewing-machine pot K is held by one bobbin hold means 2 and is then taken out from the sewing-machine pot K.

Next, the bobbin case 10 (on which the lower thread has been previously wound) held by the other bobbin hold means 2 is mounted into the sewing-machine pot K, an operator is informed that the lower thread has been replenished, and the temporary stop of the driving of the sewing machine is removed. On receiving the above information, the operator resumes the sewing operation.

After the bobbin case 10 is mounted into the sewing-machine pot K, then there is started a residual thread removing processing for removing the residual thread from the bobbin 15 and bobbin case 10 in which the lower thread has been consumed. If the residual thread removing processing is started, then, at first, the rotary arm 3 is rotated to thereby move the bobbin case 10 held by the bobbin hold means 2 to the residual thread removing position A. Next, the residual thread removing device is operated; that is, the residual thread within the bobbin 15 is all removed therefrom, for example, by air suction, or in such a manner that the residual thread is held by and between the rollers and then the rollers are rotated. If the residual thread removing processing is completed, then the rotary arm 3 is rotated to thereby move the bobbin case 10 held by the bobbin hold means 2 to the winding processing position B, with the result that a lower thread winding processing is started.

Now, FIGS. 7(*a*)–(*h*) are respectively side views of the bobbin case 10 and its peripheral portions, showing the flow of the lower thread winding processing which starts at a step of entwining the lower thread and ends at a step of cutting the lower thread.

If the lower thread winding processing is started, then the rotary arm 3 is rotated and the bobbin 15 within the bobbin case 10 being held is thereby brought into contact with the winding clutch plate 25, and the winding clutch plate 25 is pushed in further by a given stroke, so that the bobbin 15 and winding clutch plate 25 are pressed against each other.

In this state, as described before, the thread supply nozzle 36 of the lower thread supply means 30 is moved to the initial operation position N1 (see FIG. 2) to output the air into the bobbin 15 and, at the same time, the winding motor M1 is driven to rotate the bobbin 15, thereby entwining the lower thread L around the bobbin shaft 15*a* (FIG. 7(*a*)). If the lower thread L is supplied due to this entwinement and the supply of the lower thread L is detected by the thread supply detect means 60, then the lower thread supply and rotate motor M2 is driven in accordance with such thread supply detection, so that the thread supply nozzle 36 is moved to the lower thread winding position N2 (FIG. 7(*b*)).

After then, the thread handling member 40 with a moving knife is rotated counterclockwise in FIG. 7 to thereby put the lower thread L on the lower thread guiding notch 40*a* and, while guiding the lower thread L, the lower thread L is wound around the bobbin 15 (FIGS. 7(*c*)–(*d*)). Here, the lower thread guiding notch 40*a* of the thread handling member 40 with a moving knife is contacted (slidingly contacted) with the lower thread L guided from the bobbin case opening 10*a* to curve the lower thread supply passage, thereby setting the angle of insertion of the lower thread L into the bobbin case opening 10*a* in such a manner as to be able to prevent the lower thread L from touching the edge portion of the bobbin case opening 10*a*. This way of thread guide can realize nearly 100% winding of the lower thread L around the bobbin 15.

If the lower thread L is wound around the bobbin 15 by a given amount, then not only the driving of the winding motor M1 is stopped but also the thread handling member 40 with a moving knife is rotated clockwise in FIG. 7 to move apart from the lower thread L once (FIG. 7(*e*)) and, after then, the thread handling member 40 handles and guides the lower thread L, which is extended from the bobbin case opening 10*a*, up to the slit 10*b* previously formed in the peripheral side surface of the bobbin case 10; that is, a thread handling processing is started.

Now, FIGS. 8 to 15 are respectively plan views of the bobbin case 10 and the thread handling member 40 with a moving knife, explaining the position relationship between them in an operation ranging from the thread handling processing to the thread cutting processing. In these figures, a direction of an arrow CCW indicates a counterclockwise rotation direction in FIG. 7, whereas a direction of an arrow CW points out a clockwise rotation direction in FIG. 7. By the way, in these figures, it is drawn that the thread handling member 40 with a moving knife is moving with respect to the bobbin case 10 standing still. But, actually, the movements of the thread handling member 40 with a moving knife in the CCW direction and in the CW direction are obtained from the rotation of the thread handling member 40 with a moving knife along the peripheral side surface of the bobbin case 10; and, the movements of the thread handling member 40 with a moving knife in the lateral directions (in FIGS. 8 to 15, in the right and left directions) are obtained from the movement of the bobbin case 10 caused by the linear movement of the rotary arm 3.

The thread handling processing is carried out in such a manner that the thread handling member 40 with a moving knife is moved with respect to the bobbin case 10 through the courses i1–i10 that are shown in FIGS. 8–13. If the thread handling processing is started, then the movement of the thread handling member 40 through the course i1 is firstly executed; that is, the thread handling member 40 with a moving knife is rotated in the CCW direction from its initial position shown in FIG. 8 until the leading end of the thread handling member 40 with a moving knife is superimposed on the end of the bobbin case opening 10*a*.

Next, the movement of the thread handling member 40 through the course i2 is executed; that is, the thread handling member 40 with a moving knife is moved on until the thread handling notch 40*b* thereof is superimposed on the bobbin flange 15A of the bobbin case 10 on the bottom side thereof.

Then, the movement of the thread handling member 40 through the course i3 is executed; that is, the thread handling member 40 with a moving knife is rotated in the CCW direction until the top portion of the thread handling notch 40*b* of the thread handling member 40 with a moving knife is superimposed on the end of the opening 10*a* of the bobbin case 10. Due to this rotational movement, the lower thread L extended from the opening 10*a* is put on the thread handling notch 40*b* of the thread handling member 40 with a moving knife or on the inclined portion 40*f* that is formed in the thread handling member 40 in such a manner as to continue with the notch 40*b* in a gentle slope.

After then, the movement of the thread handling member 40 through the course i4 is executed; that is, the thread handling member 40 with a moving knife is moved on until the thread handling notch 40*b* thereof is superimposed on the bobbin flange 15A of the bobbin case 10 on the open end side thereof. By means of this movement, even when the lower thread L is put on the inclined portion 40*f* of the thread handling member 40 in the course i3, the lower thread L can be moved up to the thread handling notch 40*b* and is then put on the thread handling notch 40*b*.

Next, the movement of the thread handling member 40 through the course i5 is executed; that is, the thread handling member 40 with a moving knife is rotated in the CCW direction and the notch 40*b* thereof is thereby moved forward by a given amount. Thanks to this movement, the lower thread L extended from the bobbin case opening 10*a* is guided to a notch 10*aa* formed in the open end of the bobbin case opening 10*a*. This notch 10*aa* is used to facilitate the insertion of the lower thread L between the open end 10*g* of the bobbin case 10 and the bobbin flange 15A thereof.

Then, the movement of the thread handling member 40 through the course i6 is executed; that is, the notch 40*b* of the thread handling member 40 with a moving knife is moved greatly outwardly (in FIGS. 8 to 15, in the right direction) of the open end 10*g* of the bobbin case 10. This movement is obtained in such a manner that, due to the linear movement of the rotary arm 3, the bobbin case 10 is caused to move in a direction where it is separated from the winding clutch plate 25; and, the amount of this movement corresponds to an amount by which the winding clutch plate 25 is contacted with the bobbin 15 in a half-clutch state.

In this half-clutch state, the bobbin 15 is caused to float up from the bottom portion of the bobbin case 10 due to the energizing force of an idling preventive spring (not shown) provided on the inner bottom portion of the bobbin case 10, so that the inner end face of the bobbin flange 15A of the bobbin case 10 on the open end 10*b* side thereof (that is, the bobbin flange 15A located on the outside of the bobbin case 10) becomes almost flush with the end edge of the open end 10*g* of the bobbin case 10. By the way, even when the idling preventive spring is not provided, if the above half-clutch state is given, then the bobbin 15 is allowed to move in such a manner that the bobbin flange 15A of the bobbin 15 can be almost flush with the end edge of the bobbin case open end 10*g* and, therefore, due to the tension that is given when the lower thread L is moved, the bobbin 15 can be situated almost flush with the end edge of the bobbin case open end 10*g*. Also, since the notch 40*b* of the thread handling member 40 with a moving knife is moved greatly outwardly of the open end 10*g* of the bobbin case 10, the lower thread L to be extended from the bobbin case 10 is caused to lie down (that is, the extension angle of the lower thread L from the bobbin case 10 becomes small) and thus the lower thread L balances well with a state in which the lower thread L is wound 100% around the bobbin 15, which allows the lower thread L to pass smoothly through between the bobbin case open end 10*g* and bobbin flange 15A.

Next, the movement of the thread handling member 40 through the course i7 is executed; that is, the thread handling member 40 with a moving knife is rotated in the CCW direction up to a given position where the notch 40*b* of the thread handling member 40 with a moving knife is not allowed to reach the entrance of the slit 10*b* of the bobbin case 10. Due to this movement, the lower thread L is passed into between the bobbin case open end 10*g* and bobbin flange 15A.

Then, the movement of the thread handling member 40 through the course i8 is executed; that is, the notch 40*b* of the thread handling member 40 with a moving knife is moved inwardly of the open end 10*g* of the bobbin case 10 (in FIGS. 8 to 15, in the left direction). By means of this movement, the lower thread L extended from the bobbin case open end 10*g* is caused to turn back at the present open end 10*g*. Here, if, without turning back the lower thread L in this manner, the thread handling member 40 with a moving knife is moved back and forth to try to pass the lower thread L through the slit 10*b*, there can arise a problem that the lower thread L cannot be caught on a notch 10*bb* formed in the entrance of the slit 10*b* and thus the lower thread L cannot be guided into the slit 10*b* properly. However, the above-mentioned turn-back of the lower thread L at the bobbin case open end 10*g* can solve such problem and thus, in the movement of the thread handling member 40 with a moving knife through the course i10 that will be discussed later, the lower thread L is surely allowed to pass into the slit 10*b*.

Next, the movement of the thread handling member 40 with a moving knife through the course i9 is executed; that is, the thread handling member 40 is rotated in the CCW direction and the notch 40*b* of the thread handling member 40 is thereby moved greatly forwardly (in FIGS. 8 to 15, in the upper direction) of the entrance of the bobbin case slit 10*b*. Thanks to this movement, the lower thread L extended from the bobbin case 10 is allowed to move beyond the entrance of the bobbin case slit 10*b* or pass into the bobbin case slit 10*b*.

Here, the thread passage of the lower thread L on the lower thread supply side, as shown in FIG. 7(*f*), provides a passage which extends from the leading end of the thread supply nozzle 36 through the above-mentioned wiper 47 to the rear end portion of the thread handling member 40 with a moving knife. And, since the width of the thread handling member 40 with a moving knife, which extends from the top portion of the thread handling notch 40*b* thereof to the rear end thereof, has a given length, the lower thread L, which is to be arranged from the wiper 47 to the rear end portion of the thread handling member 40 with a moving knife, can be kept at a position spaced apart from the bobbin case 10.

Also, in linking with the movements of the thread handling member 40 with a moving knife through the above-mentioned courses i5, i7 and i9, the winding clutch plate 25 is rotated in the same direction as the direction where the lower thread L is guided to thereby rotate the bobbin 15 in the same direction; and, therefore, as the lower thread L is guided, the guide point of the lower thread L on the bobbin 15 is also moved similarly. Further, thanks to the rotation of the bobbin 15, the edge portion of the bobbin flange 15A in contact with the lower thread L is allowed to operate in such a manner as to feed the lower thread L toward the slit 10*b*, which makes it possible to guide the lower thread L positively.

Next, the movement of the thread handling member 40 with a moving knife through the course i10 is executed; that is, the thread handling member 40 is rotated in the CW direction and the notch 40*b* of the thread handling member 40 is thereby moved back to a position existing slightly backwardly of the entrance of the bobbin case slit 10*b* (that is, a position on the opening 10*a* side). Due to this movement, the lower thread L can be surely inserted into the slit 10*b* positively.

Then, the movement of the thread handling member 40 with a moving knife through the course i11 is executed; that is, the thread handling member 40 is rotated in the CW direction and the notch 40*b* of the thread handling member 40 is thereby moved backwardly (that is, to the bobbin case opening 10*a* side). This movement removes the lower thread L from the notch 40*b* of the thread handling member 40. Also, the movement of the thread handling member 40 through the course i11 is carried out by means of a slight intermittent operation; that is, thanks to the slight intermittent operation, the lower thread L inserted through the bobbin case slit 10*b* can be surely guided up to the lower thread tension adjust spring 11.

Also, in linking with the movements of the thread handling member 40 with a moving knife through the above-mentioned courses i10 and i11, the winding clutch plate 25 is rotated in the same direction as the direction where the lower thread L is wound to thereby rotate the bobbin 15 in the same direction; and, therefore, the lower thread L is pulled into the bobbin 15 and tension is applied to the lower thread L and, due to this tension, the lower thread L can be surely guided to the bobbin case slit 10*b* and lower thread tension adjust spring 11.

Figure 14:
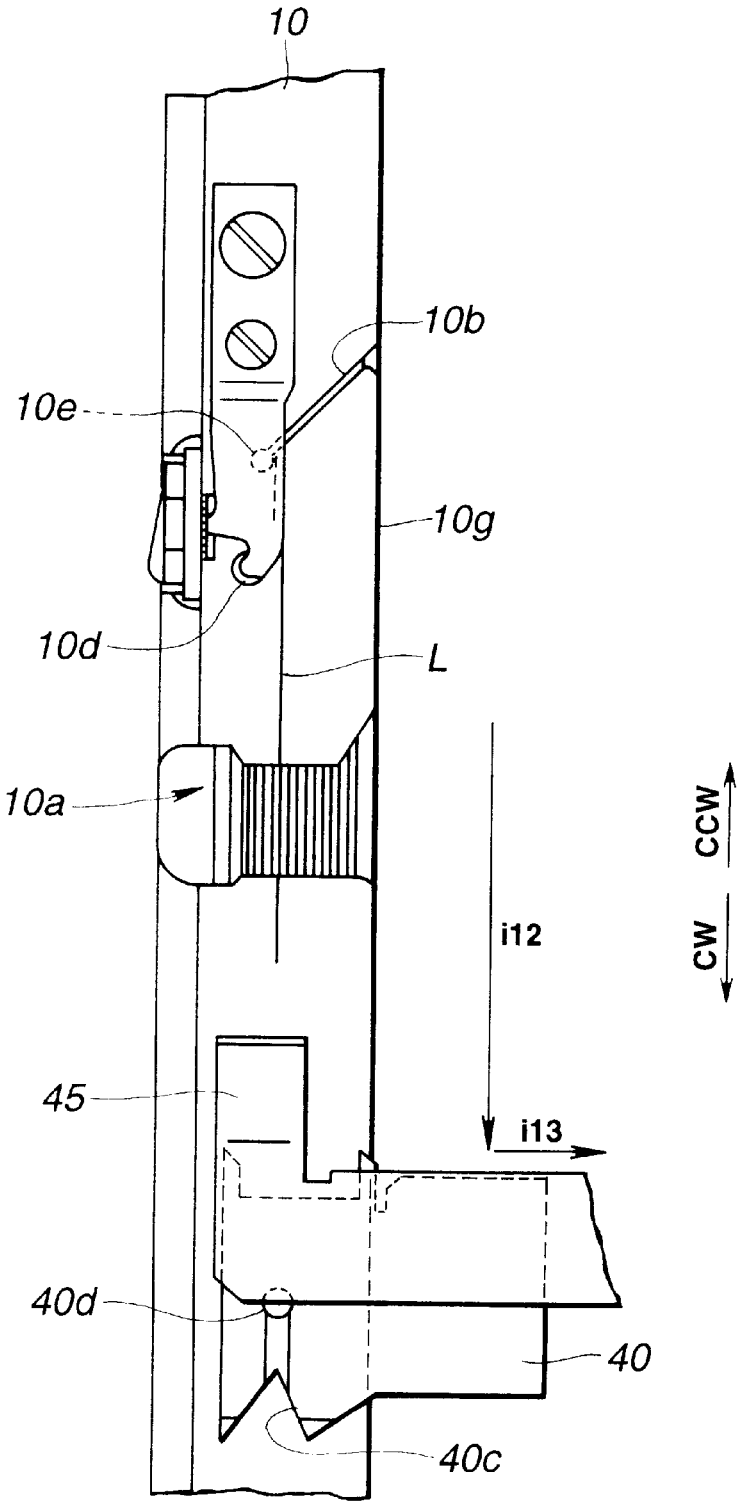
FIG. 14 is a plan view to show a seventh step in the above thread-handling to thread-cutting operation.

Next, the movements of the thread handling member 40 with a moving knife through the courses i12 and i13 shown in FIG. 14 are respectively executed and the thread handling member 40 is returned to the initial position, which completes the thread handling processing. On completion of the thread handling processing, a thread catch processing to be executed by a thread catch mechanism is then started.

Figure 16A:
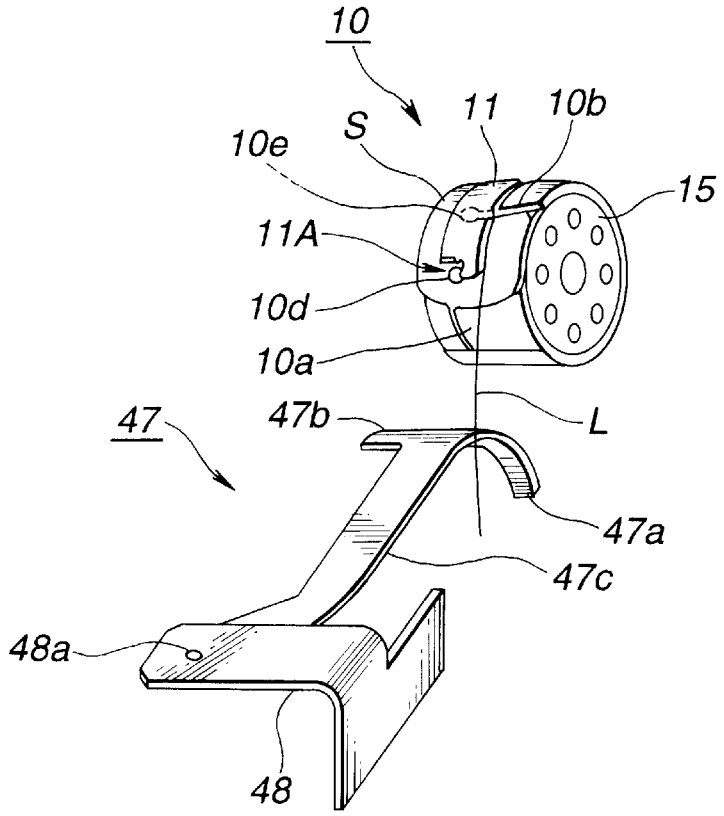
Figure 16B:
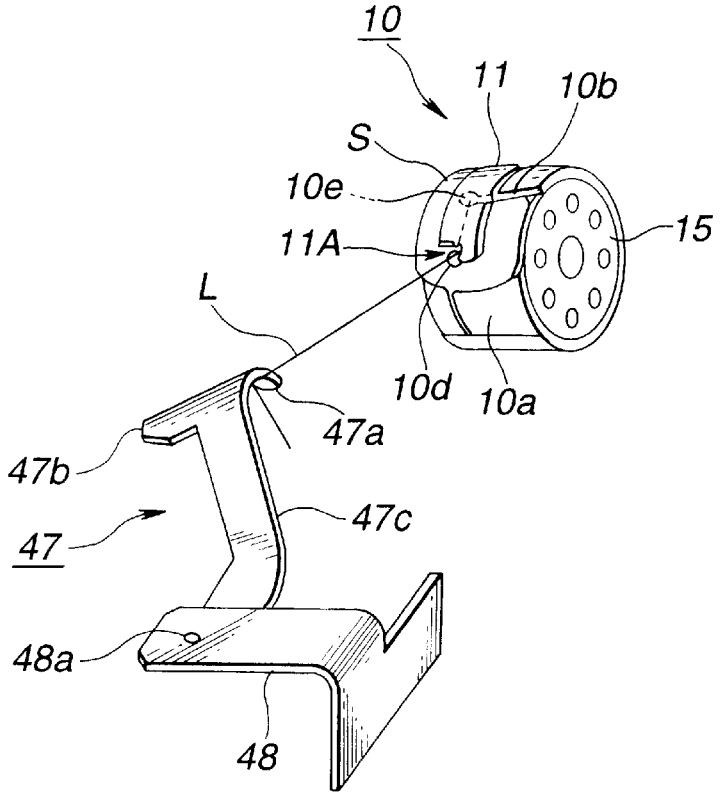

Now, FIG. 16 is an explanatory view of the outline of the thread catch processing to be executed by the thread catch mechanism. In particular, FIG. 16(*a*) is a perspective view of the thread catch mechanism before the wiper 47 is operated; and, FIG. 16(*b*) is a perspective view of the thread catch mechanism after the wiper 47 is operated.

If the thread catch processing is started, then, as shown in FIG. 16, the wiper 47 is driven or rotated about the fulcrum 48*a* so that the lower thread L hitched on the thread hitch member 47*a* is guided laterally along the peripheral side surface of the bobbin case 10. And, due to this guide, the lower thread L, which has been passed through the bobbin case slit 10*b* into below the lower thread tension adjust spring 11, is guided up to the thread guide portion 10*d*. After then, the wiper 47 is returned to its original position, thereby completing the thread catch processing.

Figure 15:
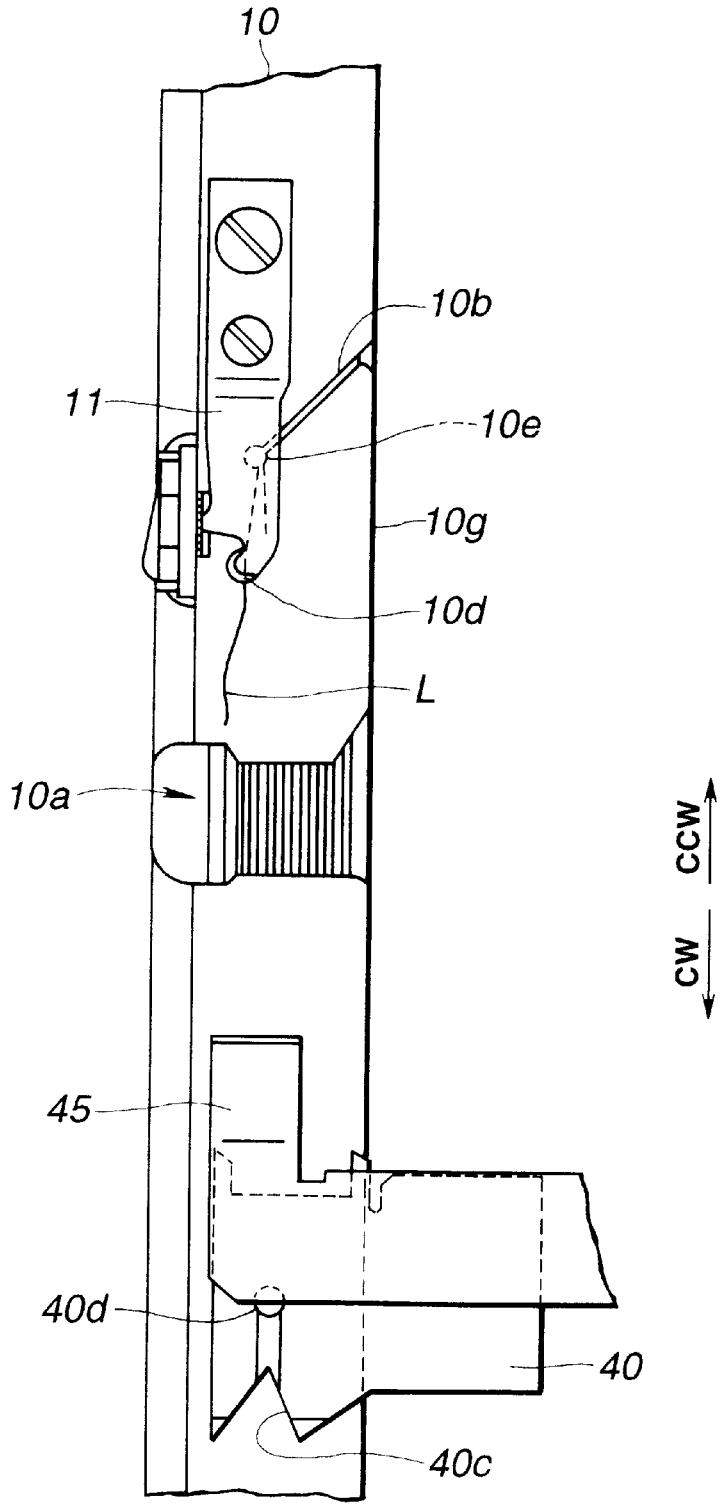
FIG. 15 is a plan view to show an eighth step in the above thread-handling to thread-cutting operation; and, FIG. 16 shows the outline of a thread catching processing to be executed by a wiper after the thread handling processing is executed; in particular, FIG. 16(*a*) is a perspective view of the lower thread winding device before the wiper is operated; and, FIG. 16(*b*) is a perspective view of the lower thread winding device after the wiper is operated.

Next, a thread cutting operation is started. In particular, as shown in FIG. 7(*g*), the thread handling member 40 with a moving knife is rotated clockwise once, whereby the lower thread L passed from the thread guide portion 10*d* of the bobbin case 10 to the wiper 47 is held by the thread cutting notch 40*c*; and, after then, as shown in FIGS. 15 and 7(*h*), the thread handling member 40 with a moving knife continues to rotate clockwise and is thus superimposed on a fixed knife 45, so that the lower thread L held on the thread cutting notch 40*c* is sandwiched between the fixed knife 45 and eyeball 40*d* and thus the lower thread L can be cut at a given position.

And, the bobbin 15 and bobbin case 10 are respectively put into their usable states and they wait in the usable states until the lower thread in the bobbin within the sewing-machine pot K is consumed and thus the next lower thread automatic supply processing is started.

As has been described heretofore, with use of the lower thread winding device according to the present embodiment, when the thread handling member 40 with a moving knife guides the lower thread L from the opening 10*a* of the bobbin case 10 to the slit 10*b* thereof, the bobbin 15 stored within the bobbin case 10 is kept in contact with the winding clutch plate 25. This can solve the problem found in the conventional lower thread winding device that the flange 15A of the bobbin 15 can stick out from the bobbin case 10 and thus the lower thread L wound around the bobbin 15 can fly out from the bobbin 15.

Also, in the above operation, the winding clutch plate 25 is not in a full clutch state in which it presses fully the bobbin 15 against the inside portion of the bobbin case 10 but in a half-clutch state in which it allows the bobbin 15 to float up from the bottom of the bobbin case 10. Thanks to this, the lower thread to be dealt with by the thread handling member is allowed to pass smoothly through between the open end 10*g* of the bobbin case 10 and the flange 15A of the bobbin 15 and thus move from the opening 10*a* of the bobbin case 10 to the slit 10*b* thereof positively.

Further, when the thread handling member 40 with a moving knife guides the lower thread L from the opening 10*a* of the bobbin case 10 to the slit 10*b* thereof, the bobbin 15 is rotated and, due to the rotation of the bobbin 15, the lower thread L held by and between the open end 10*g* of the bobbin case 10 and the flange 15A of the bobbin 15 is pushed toward the bobbin case slit 10*b* side, so that the lower thread L can be moved smoothly from the opening 10*a* of the bobbin case 10 to the slit 10*b* thereof.

Still further, in the thread handling member 40 with a moving knife, the lower thread guide for guiding the lower thread L during the supply of the lower thread L, thread handling member, and moving knife are connected together into an integrally united body, that is, these components are structured as a united part. This not only can reduce the manufacturing cost of the thread handling member 40 with a moving knife, but also the structure thereof can be made compact. Thanks to the compact structure, even if a lower thread winding device is structured such that the thread supply means 30 and bobbin rotate means 20 are clustered close together in the periphery of the bobbin case 10 and thus there is left only a limited space in the periphery of the bobbin case 10, the lower thread guide, thread handling member and moving knife can be installed in the periphery of the bobbin case 10.

Moreover, the thread handling member 40 with a moving knife has a width of a given length extending from the front end thereof to the rear end thereof when it is viewed in the peripheral direction of the peripheral side surface of the bobbin case 10. That is, 20 thanks to this, while the lower thread can be handled on one side (in particular, on the notch 40*b* formed on the front end side of the thread handling member 40) in such bobbin case peripheral direction, the lower thread L on the lower thread supply side can be held on the other side (on the rear end side of the thread handling member 40), so that the lower thread L on the lower thread supply side can be kept spaced apart from the peripheral side surface of the bobbin case 10. This can prevent the possibility that, when the thread handling member 40 with a moving knife handles and guides the lower thread L, the lower thread L on the lower thread supply side can get entangled in error around the thread supply means 30 and bobbin rotate means 20 or can be caught and cut by them in error.

By the way, the present invention is not limited to the lower thread winding device according to the present embodiment. For example, in the half-clutch state in the lower thread handling processing, it is not always necessary that the inner surface side of the bobbin flange 15A is almost superimposed on the open end 10*g* of the bobbin case 10, but the effect to prevent the lower thread L from flying out from the bobbin 15 can be provided, even if the inner surface side of the bobbin flange 15A is situated inwardly of the open end 10*g* of the bobbin case 10. Also, the structures and methods that have been illustrated hereinbefore, such as the moving courses of the thread handling member and the movement contents of the bobbin in the thread handling processing, the structure for moving the thread handling member with respect to the bobbin case, and the like can be changed properly without departing from the scope and spirit of the patent claims set forth herein. Further, the structures of the lower thread supply means and bobbin rotate means of the lower thread winding device, the structures of the thread supply detect means and lower thread storage/guide means, and the like illustrated in the present embodiment are just examples and thus the invention is not limited to these structures.

According to the invention, when the thread handling member guides the lower thread from the opening of the bobbin case to the slit thereof, the mutual contact between the bobbin stored within the bobbin case and the rotary body of the bobbin rotate means is not removed but is maintained, which can solve the conventional problem that the flange of the bobbin can stick out from the bobbin case and thus the lower thread wound around the bobbin can fly out from the bobbin.

According to the invention, when the thread handling member guides the lower thread, the pressing forces of the rotary member and bobbin against each other is weakened in such a manner that the inner surface of the bobbin flange is situated inwardly of and almost flush with the open surface of the bobbin case. Thanks to the thus set half-clutch state, the position relation between the bobbin and bobbin case can be set best for the purpose of not only preventing the lower thread from flying out but also moving the lower thread smoothly in the thread handling processing.

According to the invention, when the thread handling member guides the lower thread from the opening of the bobbin case to the slit thereof, the idling of the bobbin can be prevented, so that the lower thread can be guided to the bobbin case slit positively.

According to the invention, when the thread handling member guides the lower thread from the opening of the bobbin case to the slit thereof, the lower thread by and between the edge portion of the bobbin case and the flange of the bobbin is pushed toward the bobbin case slit due to the rotation of the bobbin, which allows the lower thread to move smoothly and positively.

According to the invention, at least two of the lower thread guide, thread handling member and cutting member are formed as an integrally united body, namely, as a single part. This not only can reduce the manufacturing cost of the lower thread winding device but also can make the device compact in structure.

According to the invention, when the thread handling member handles and guides the lower thread, it is possible to prevent the possibility that, when the thread handling member guides the lower thread, the lower thread on the lower thread supply source side can be entwined in the structure of the lower thread winding means, or can be caught and cut therein.

What is claimed is:

1. A lower thread device comprising:

lower thread supply means for guiding a lower thread out from a lower thread supply source and also for supplying said lower thread to a bobbin through an opening formed in a bobbin case;

bobbin rotate means including a rotary body disposed on a bobbin within said bobbin being contactable with and separable from said bobbin, said bobbin rotate means being capable of rotating said bobbin due to mutual contact between said rotary body and said bobbin to thereby wind said lower thread around said bobbin; and a thread handling member for handling a lower thread extended from said bobbin case to said lower thread supply source to thereby guide said lower thread from said opening of said bobbin case up to a slit formed in the peripheral side surface of said bobbin case, wherein the pressing forces of said bobbin rotate means and said bobbin against each other is set in a half-clutch state.

2. A lower thread winding device as set forth in claim 1, wherein, when said thread handling member guides said lower thread, the pressing forces of said rotary member of said bobbin against each other is weakened until the inner surface of said bobbin flange is situated inwardly and almost flush with the open surface of said bobbin case.

3. A lower thread winding device as set forth in claim 2, wherein said rotary body includes a projection portion and is structured such that, with said projecting portion inserted into a hole portion formed in the flange of said bobbin, said projecting portion rotates to thereby be able to transmit its rotational movement to said bobbin and also wherein, when said thread handling member guides said lower thread, the pressing forces of said rotary member and said bobbin against each other is weakened while said projecting portion of said rotary body remains inserted into a hole portion formed in the flange of said bobbin.

4. A lower thread winding device as set forth in claim 2, wherein, when said thread handling member guides said lower thread from said bobbin case opening to said bobbin case slit along the edge portion of the open surface side of said bobbin case, said bobbin is rotated in a direction where said lower thread is guided.

5. A lower thread winding device as set forth in claim 1, wherein said rotary body includes projecting portion and is structured such that, with said projecting portion inserted into a hole portion formed in the flange of said bobbin, said projecting portion rotates to thereby be able to transmit its rotation movement to said bobbin and also wherein, when said thread handling member guides said lower thread, the pressing forces of said rotary member and said bobbin against each other is weakened while said projecting portion of said rotary body remains inserted into a hole portion formed in the flange of said bobbin.

6. A lower thread winding device as set forth in claim 3, wherein, when said thread handling member guides said lower thread from said bobbin case opening to said bobbin case slit along the edge portion of the open surface side of said bobbin case, said bobbin is rotated in a direction where said lower thread is guided.

7. A lower thread winding device as set forth in claim 1, wherein, when said thread handling member guides said lower thread from said bobbin case opening to said bobbin case slit along the edge portion of the open surface side of said bobbin case, said bobbin is rotated in a direction where said lower thread is guided.

8. A lower thread winding device comprising;

lower thread supply means for guiding a lower thread out from a lower Thread supply source and also for supplying said lower thread to a bobbin through an opening formed in a bobbin case;

bobbin rotate means for rotating a bobbin within said bobbin case so that said lower thread guided out from said lower thread supply means can be wound around said bobbin;

a lower thread guide capable of touching said lower thread extending from said lower thread supply means to said bobbin and curving the supply passage of said lower thread to thereby adjust the insertion angle of said lower thread in order to prevent said lower thread supplied from touching the end of said opening of said bobbin case curing winding of said lower thread around said bobbin;

a thread handling member for handling said lower thread extended from said bobbin case to said lower thread supply source to thereby guide said lower thread from said opening of said bobbin case to a slit formed in the peripheral side surface of said bobbin case while said bobbin rotate means and said bobbin are engaged in a halt-clutch state; and a cutting member for cutting a given portion of said lower thread extended our from said bobbin case, wherein at least two of said lower thread guide, said thread handling member and said cutting member are formed as an integrally united body on the same surface extending along the peripheral side surface of said bobbin case.

* * * * *